US010205240B2

(12) United States Patent
McMichael et al.

(10) Patent No.: US 10,205,240 B2
(45) Date of Patent: Feb. 12, 2019

(54) SHORTED ANNULAR PATCH ANTENNA WITH SHUNTED STUBS

(71) Applicant: The MITRE Corporation, McLean, VA (US)

(72) Inventors: Ian T. McMichael, Stow, MA (US); Erik T. Lundberg, Cambridge, MA (US); Frank S. Kolak, Groton, MA (US)

(73) Assignee: The MITRE Corporation, McLean, VA (US)

( * ) Notice: Subject to any disclaimer, the term of this patent is extended or adjusted under 35 U.S.C. 154(b) by 115 days.

(21) Appl. No.: 14/871,880

(22) Filed: Sep. 30, 2015

(65) Prior Publication Data

US 2017/0093042 A1 Mar. 30, 2017

(51) Int. Cl.
*H01Q 9/04* (2006.01)

(52) U.S. Cl.
CPC ..... *H01Q 9/0428* (2013.01); *H01Q 9/0414* (2013.01); *H01Q 9/0435* (2013.01); *H01Q 9/0464* (2013.01)

(58) Field of Classification Search
CPC .. H01Q 9/0407; H01Q 9/0414; H01Q 9/0464; H01Q 9/045; H01Q 9/0421; H01Q 9/0428; H01Q 13/08; H01Q 13/18; H01Q 1/526; H01Q 9/0435
See application file for complete search history.

(56) References Cited

U.S. PATENT DOCUMENTS 4,379,296 A * 4/1983 Farrar ..... H01Q 3/247 343/700 MS
5,099,249 A 3/1992 Seavey
5,371,507 A 12/1994 Kuroda et al.
5,861,848 A * 1/1999 Iwasaki ..... H01Q 9/0407 343/700 MS
6,124,829 A 9/2000 Iwasaki
(Continued)

FOREIGN PATENT DOCUMENTS

JP 1-318408 12/1989
JP 5-29181 2/1993

OTHER PUBLICATIONS

Fries, Matthias K. et al., "A Reconfigurable Slot Antenna With Switchable Polarization," *IEEE Microwave and Wireless Components Letters*, vol. 13, No. 11, Nov. 2003, pp. 490-493.
(Continued)

*Primary Examiner* — Tho G Phan
*Assistant Examiner* — Patrick Holecek
(74) *Attorney, Agent, or Firm* — Morrison & Foerster LLP

(57) ABSTRACT

A microstrip antenna for circularly polarized radiation including a substrate, a ground layer disposed on a first side of the substrate, a first radiating layer disposed on a second side of the substrate opposite the first side, one or more first electrically conductive pathways extending from the ground layer to the first radiating layer, wherein the one or more first electrically conductive pathways form a ring about an axis, one or more second electrically conductive pathways extending from the ground layer to the first radiating layer, wherein the one or more second electrically conductive pathways are disposed along a portion of a first line extending outwardly from the ring, and a feed conductor for connecting the antenna to a feed line.

17 Claims, 12 Drawing Sheets

(56) References Cited

U.S. PATENT DOCUMENTS

| | | | | |
|---|---|---|---|---|
| 6,597,316 | B2 | 7/2003 | Rao et al. | |
| 7,436,363 | B1 | 10/2008 | Klein et al. | |
| 7,609,211 | B2 * | 10/2009 | Hsu | H01Q 1/38 343/700 MS |
| 7,659,860 | B2 | 2/2010 | Manholm et al. | |
| 8,106,832 | B2 | 1/2012 | DeVita | |
| 8,373,609 | B1 | 2/2013 | Dorsey et al. | |
| 8,928,544 | B2 | 1/2015 | Massie et al. | |
| 9,386,688 | B2 * | 7/2016 | MacDonald | H01L 23/552 |
| 2003/0052825 | A1 | 3/2003 | Rao et al. | |
| 2003/0146872 | A1 | 8/2003 | Kellerman et al. | |
| 2004/0113841 | A1 | 6/2004 | Louzir et al. | |
| 2009/0102723 | A1 | 4/2009 | Mateychuk et al. | |
| 2010/0090903 | A1 * | 4/2010 | Byun | H01Q 9/0407 343/700 MS |
| 2010/0245204 | A1 * | 9/2010 | Lee | H01Q 9/0407 343/860 |
| 2012/0268347 | A1 | 10/2012 | Tatarnikov et al. | |
| 2013/0321227 | A1 | 12/2013 | Ratajczak | |
| 2014/0266959 | A1 | 9/2014 | Xue et al. | |
| 2015/0041541 | A1 | 2/2015 | Qu et al. | |
| 2015/0069134 | A1 | 3/2015 | Westrick | |

OTHER PUBLICATIONS

Bao, X.L., et al., "Comparison of Several Novel Annular-Ring Microstrip Patch Antennas for Circular Polarization," *Journal of Electromagnetic Waves and Applications*, vol. 20, Issue 11, 2006; 20 pages.

Kim, Boyan et al., "A Novel Single-Feed Circular Microstrip Antenna With Reconfigurable Polarization Capability," *IEEE Transactions on Antennas and Propagation*, vol. 56, No. 3, Mar. 2008, pp. 630-638.

Latif, Saeed Iftakhar Reza, "Performance Enhancement Techniques for Microstrip Square Ring Antennas," *A Thesis Submitted to the Faculty of Graduate Studies, Department of Electrical and Computer Engineering, The University of Manitoba*, Winnipeg, Manitoba, Canada, Nov. 2008; 201 pages.

McMichael et al. U.S. Office Action dated Oct. 10, 2017, directed to U.S. Appl. No. 14/871,877; 15 pages.

* cited by examiner

SHORTED ANNULAR PATCH ANTENNA WITH SHUNTED STUBS

CROSS REFERENCE TO RELATED APPLICATIONS

This application is related to U.S. application Ser. No. 14/871,877 , titled "COPLANAR WAVEGUIDE TRANSITION FOR MULTI-BAND IMPEDANCE MATCHING," filed on Sep. 30, 2015, the entire contents of which is incorporated herein by reference in its entirety.

FIELD OF THE INVENTION

This invention relates generally to radio-frequency antennas and, more specifically, to microstrip patch antennas.

BACKGROUND OF THE INVENTION

Global Navigation Satellite Systems (GNSS) such as the U.S. NAVSTAR Global Positioning System (GPS), the European Galileo system, the Chinese Beidou system, and the Russian GLONASS system are increasingly relied upon to provide synchronized timing that is both accurate and reliable. (Reference is made to GPS below, by way of example and simplicity, but similar characteristics and principles of operation apply to other GNSS.) GPS antennas are used to receive GPS signals and provide those signals to a GPS receiver. GPS antennas may amplify and filter the received GPS signals prior to passing them to the GPS receiver. The GPS receiver can then calculate position, velocity, and/or time from the signals collected by the GPS antenna. GPS timing antennas at fixed sites are susceptible to unintentional interference, such as out-of-band and multipath signals, as well as intentional interference from ground-based GPS jammers commonly employed to deny, degrade, and/or deceive GPS derived position and time.

Accurate GPS-based navigation and timing systems rely on receiving signals from at least four GPS satellites simultaneously. GPS timing systems can provide time when a single GPS satellite is observed if the position of the antenna is already known. Analysis has shown that a GPS timing antenna with a half power beam width (HPBW) of 60 degrees will have access at least 3 satellites 95% of the time, which is sufficient for timing applications. GPS satellites transmit right-hand circularly polarized (RHCP) signals, and thus, GPS antennas must be right-hand circularly polarized.

Microstrip patch antennas are often used in GPS applications due to their compact structure, light weight, and low manufacturing cost. Several types of antennas have been previously developed to mitigate interference while maintaining a sufficient RCHP HPBW for GPS applications, such as large antenna arrays, the horizon ring nulling antennas, and shorted annular ring antennas. Many of these steer a null (local gain minimum) in the direction from which interfering signals are received (such as the horizon). For example, large antenna arrays such as controlled reception pattern antennas (CRPA), steer a null in the direction of the interference using active circuitry. While CRPAs can achieve exceptional nulling in a particular direction, they can be large due to the multiple antenna elements necessary for null steering, are typically expensive due to the required active electronics, and can only null a finite number of interfering signals.

Horizon ring nulling (HRN) antennas, as described in U.S. Pat. No. 6,597,316, which is incorporated herein in its entirety, can achieve a measured RHCP null depth (i.e., zenith-to-horizon gain ratio) of approximately −45 dB on average around the entire azimuth. The HRN is composed of a shorted annular ring patch, such as that described in V. Gonzalez-Posadas, el al, Approximate Analysis of Short Circuited Ring Patch Antenna Working at TM01 Mode, IEEE Transactions on Antennas and Propagation, Vol. 54, No. 6, June 2006, combined with a circular patch with amplitude and phase weighting to create a null at the horizon. While the HRN's performance is exceptional with regard to its horizon nulling capability, its cost is relatively high due to the required active electronics. Additionally, the exceptional null of the HRN degrades significantly when installed near other scattering objects, which typically occurs for which happens in most real world installation environments.

Thus, a low cost RHCP antenna with sufficient beamwidth and deep horizon nulls is desired for GPS applications.

BRIEF SUMMARY OF THE INVENTION

According to some embodiments, shorted annular ring (SAR) microstrip patch antennas that can provide RHCP with only a single feed port are described herein. According to some embodiments, a SAR microstrip patch antenna is provided with grounding pathways (shunted stubs) projecting from the inner diameter of the annulus to enable RHCP with just a single feed port spaced 45 degrees from one of the pathways. These antennas can be configured for multi-band GPS timing reception through stacking of single-mode radiators. In some embodiments, antennas include a deep null in the RHCP gain pattern at the horizon in a full ring around azimuth for ground-based interference rejection. Antennas, according to some embodiments, can be made using low-cost printed circuit board (PCB) architecture. The simplified architecture reduces the number of electronic components necessary to support circular polarization and horizon nulling, thereby reducing the manufacturing cost compared to antennas with similar horizon nulling capability.

According to some embodiments, a microstrip antenna for circularly polarized radiation includes a substrate, a ground layer disposed on a first side of the substrate, a first radiating layer disposed on a second side of the substrate opposite the first side, one or more first electrically conductive pathways extending from the ground layer to the first radiating layer, wherein the one or more first electrically conductive pathways form a ring about an axis, one or more second electrically conductive pathways extending from the ground layer to the first radiating layer, wherein the one or more second electrically conductive pathways are disposed along a portion of a first line extending outwardly from the ring, and a feed conductor for connecting the antenna to a feed line.

In any of these embodiments, the microstrip antenna can be configured to generate a circularly polarized radiation field in response to receiving an electrical signal through the feed conductor. In any of these embodiments, the first line can intersect the axis of the ring.

In any of these embodiments, a second line intersecting the feed pin and the axis can form an acute angle with the first line. In any of these embodiments, the acute angle can be in a range from 30 to 60 degrees. In any of these embodiments, the acute angle can be in a range from 40 to 50 degrees. In any of these embodiments, the acute angle can be about 45 degrees.

In any of these embodiments, the first radiating layer can be circular. In any of these embodiments, the one or more first electrically conductive pathways can include a plurality of conductive vias extending through the thickness of the substrate.

In any of these embodiments, the plurality of metal vias can include circumferential spacing of less than one-twentieth of a resonant frequency wavelength of the radiating layer. In any of these embodiments, the one or more second electrically conductive pathways can include a plurality of conductive vias extending through the thickness of the substrate. In any of these embodiments, the axis can extend perpendicularly to the substrate.

In any of these embodiments, the microstrip antenna can be configured with an operating frequency gain null extending circumferentially about the axis. In any of these embodiments, the gain null can be at least 45 degrees from the axis. In any of these embodiments, the gain null can be at least 80 degrees from the axis.

In any of these embodiments, the gain null can include a gain that is at least 10 decibels relative to an isotropic antenna (dBi) less than a gain at a zenith of the antenna. In any of these embodiments, the gain can be at least 20 dBi less than the gain at the zenith of the antenna.

In any of these embodiments, the antenna can include a second substrate disposed on the first radiating layer, a second radiating layer disposed on a side of the second substrate opposite the first radiating layer, one or more third electrically conductive pathways extending from the first radiating layer to the second radiating layer, wherein the one or more third electrically conductive pathways form a second ring about a second axis, one or more fourth electrically conductive pathways extending from the first radiating layer to the second radiating layer, wherein the one or more fourth electrically conductive pathways are disposed along a portion of a second line extending outwardly from the second ring, and a second feed conductor electrically connected to the feed conductor, the second feed conductor configured to provide radiative energy to the second radiating layer.

DETAILED DESCRIPTION OF THE INVENTION

Figure 1A:
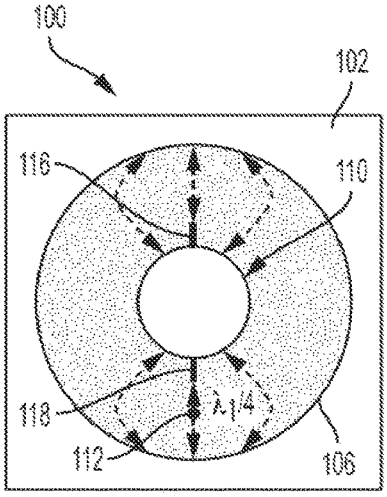
FIG. 1A is an illustration of a SAR antenna configured to resonate in a first linear mode, according to some embodiments.

Described within are SAR microstrip patch antennas that can provide RHCP with only a single feed port. According to some embodiments, a SAR microstrip patch antenna is provided with grounding pathways (shunted stubs) projecting from the inner diameter of the annulus to enable RHCP with just a single feed port spaced 45 degrees from one of the pathways. In some embodiments, antennas include a deep null in the RHCP gain pattern at the horizon in a full ring around azimuth for ground-based interference rejection. These antennas can be configured for dual-band GPS timing reception through stacking of single-mode radiators. Antennas, according to some embodiments, can be made using low-cost PCB architecture. The simplified architecture reduces the number of electronic components necessary to support circular polarization and horizon nulling, thereby reducing the manufacturing cost compared to antennas with similar horizon nulling capability.

The SAR patch antenna is a well-known design often used in GPS applications that has been researched extensively for its reduced surface wave property. It has been shown that surface waves are not excited when the outer radius of the ring is a particular critical value. It has also been shown that the gain pattern of the SAR patch antenna can be tailored by choosing the inner and outer radii of the ring while maintaining the desired resonant frequency. However, the outer radius has typically been constrained to suppress surface waves, which limits the range of gain pattern shaping in the design process. According to some embodiments, antennas can create a null at the horizon for interference rejection at the expense of a narrower HPBW relative to a conventional patch antenna. However, the HPBW can still be sufficient for timing applications. According to some embodiments, by relaxing the surface wave constraint, a location of a deep null in the gain pattern can be controlled and placed precisely at the horizon (or some other elevation), such that the antenna can be relatively insensitive to signals received from the horizon, which for GPS antennas are typically ground-based interfering signal sources. For applications that include an isolated antenna installation, surface waves may not degrade the performance of the isolated antenna and, therefore, horizon null placement can be achieved with minimal impact on antenna performance.

As is known in the art, microstrip patch antennas, including SAR patch antennas, can be configured to operate with circular polarization. In SAR antenna elements, circular polarization is typically achieved using either two feed ports located 90 degrees apart and phased 90 degrees apart or 4 feed ports. According to some embodiments, SAR antennas can be configured to operate with circular polarization with just a single feed port. Generally, SAR patch antennas are composed of a planar ring over a thin grounded dielectric substrate, with the inner radius of the ring shorted to ground. According to some embodiments, circular polarization is achieved with just a single feed port by including "shunted stubs" that project radially from the inner annulus diameter a certain distance (depending on the desired operating frequency). These shunted stubs short the radiating layer to the underlying ground plane. The feed port can be placed along a radial line oriented about 45 degrees from one of the shunted stubs. This placement excites two modes shifted 90 degrees apart. The radiation pattern at the frequency at which these modes cross is circularly polarized (either right-hand or left-hand, depending on the orientation of the feed port at + or −45 degrees).

According to some embodiments, performance of multi-band stacked microstrip patch antennas can be improved by independently positioning the feed points of each radiating layer. Conventional stacked microstrip patch antennas include a single feed structure that extends through each radiating layer at a single radial position. Because each radiating layer typically has its own distinct impedance pattern, the location of the feed structure cannot be optimized for each radiator, but instead represents a compromise. According to embodiments described below, a novel feed structure enables radiating layers to be fed at independent radial locations by incorporating a disjointed feed structure in which one segment is connected to the next segment by a coplanar waveguide transition within a radiating layer. This can allow impedance matching for each operating frequency, reducing impedance mismatch loss relative to conventional microstrip patch antennas.

In the following description of the disclosure and embodiments, reference is made to the accompanying drawings in which are shown, by way of illustration, specific embodiments that can be practiced. It is to be understood that other embodiments and examples can be practiced, and changes can be made, without departing from the scope of the disclosure.

In addition, it is also to be understood that the singular forms "a," "an," and "the" used in the following description are intended to include the plural forms as well, unless the context clearly indicates otherwise. It is also to be understood that the term "and/or"," as used herein, refers to and encompasses any and all possible combinations of one or more of the associated listed items. It is further to be understood that the terms "includes, "including," "comprises," and/or "comprising," when used herein, specify the presence of stated features, integers, steps, operations, elements, components, and/or units, but do not preclude the presence or addition of one or more other features, integers, steps, operations, elements, components, units, and/or groups thereof.

Reference is made herein to antennas including radiating elements of a particular size and shape. For example, certain embodiments of radiating element are described having a shape and a size compatible with operation over a particular frequency range (e.g., 1-2 GHz). Those of ordinary skill in the art would recognize that other shapes of antenna elements may also be used and that the size of one or more radiating elements may be selected for operation over any frequency range in the RF frequency range (e.g., any frequency in the range from below 20 MHz to above 50 GHz).

Reference is sometimes made herein to generation of an antenna beam having a particular shape or beam-width. Those of ordinary skill in the art would appreciate that antenna beams having other shapes may also be used and may be provided using known techniques, such as by inclusion of amplitude and phase adjustment circuits into appropriate locations in an antenna feed circuit and/or multi-antenna element network.

Although antennas in GPS receivers operate in the receive mode, standard antenna engineering practice characterizes antennas in the transmit mode. According to the well-known antenna reciprocity theorem, however, antenna characteristics in the receive mode correspond to antenna characteristics in the transmit mode. Accordingly, the below description provides certain characteristics of antennas operating in a transmit mode with the intention of characterizing antennas equally in the receive mode.

Figure 1B:
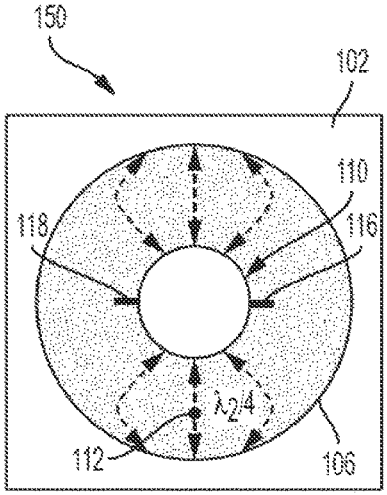
FIG. 1B is an illustration of a SAR antenna configured to resonate in a second linear mode, according to some embodiments.
Figure 1C:
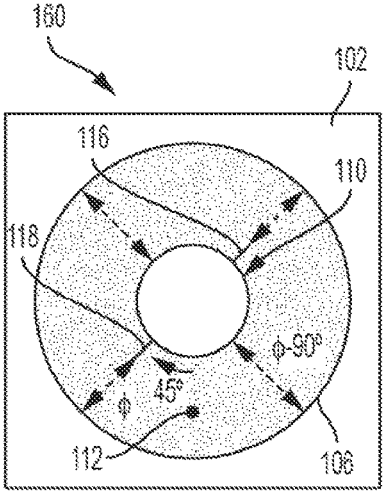
FIG. 1C is an illustration of a SAR antenna configured to resonate in a circularly polarized mode, which is a combination of the modes of FIGS. 1A and 1B, according to some embodiments.

FIGS. 1A-1D illustrate the use of shunted stubs to generate a circularly polarized radiation field according to some embodiments. FIGS. 1A, 1B, and 1C illustrate shorted annular antennas 100, 150, and 160, respectively. Each antenna includes a dielectric substrate 102 with a ground plane on the bottom side (not shown) and circular radiating layer 106 on the top side. Shorting ring 110 extends from radiating layer 106, through the thickness of substrate 102, to the ground plane in order to ground radiating layer 106 to the ground plane, forming the inner radius of the annular antenna. Two shunted stubs 116 and 118 also extend through the thickness of substrate 102 to electrically ground radiating layer 106 to the ground plane. Shunted stub 116 extends radially from shorting ring 110 in a first direction and shunted stub 118 extends radially from shorting ring 110 in an opposite direction such that it can be substantially collinear with shunted stub 116. Antennas 100, 150, and 160 also include feed pin 112 for feeding radiating layer 106 with an electrical excitation signal. Feed pin 112 extends through the thickness of substrate 102 to radiating layer 106. Generally, the antennas are driven by an electrical signal propagating through the feed pin with a frequency corresponding to the resonant frequency of the radiating layer.

In antenna 100 of FIG. 1A, feed pin 112 is collinear with shunted stub 118. Antenna 100 is configured to resonate in a first linear mode determined, in part, by the outer radius of radiating layer 106 and the radius of the end of the shunted stub (e.g., the radial distance from the end of the shunted stub to the outer radius of the radiating layer may be proportional to a quarter-wavelength of the center frequency of the operating frequency band). In antenna 150 of FIG. 1B, feed pin 112 is located along a radial line that is 90 degrees from the radial lines of the shunted stubs 116 and 118. Antenna 150 is configured to resonate in a second linear mode that is largely unaffected by the shunted stubs (e.g., the radial distance from the shorting ring to the outer radius of the radiating layer may be proportional to a quarter-wavelength of the center frequency of the operating frequency band). In antenna 160 of FIG. 1C, feed pin 112 is located along a radial line that is 45 degrees from the radial line of shunted stub 118. With this feed pin placement, antenna 150 is configured to resonate at both the first and second modes, with the two modes 90 degrees out of phase. The combination of these two linear modes 90 degrees out of phase can enable circular polarization.

Figure 1D:
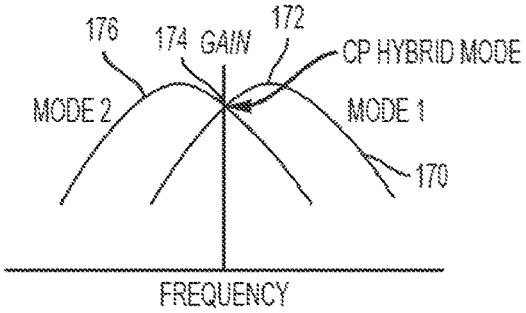
FIG. 1D is an illustration of the gain patterns of the antennas of FIG. 1A and FIG. 1B, showing that the circularly polarized mode occurs at a cross-over frequency of the modes from FIG. 1A and FIG. 1B, according to some embodiments.

FIG. 1D illustrates the two modes of antenna 160. Mode 1 170, which is based on the length of the shunted stubs, has peak gain 172 at a higher frequency than peak gain 176 of mode 2. Mode 1 and mode 2 have equal gain at frequency 174, where the two curves overlap. The two linear modes of equal amplitude and 90-degree phase shift can combine to generate a circularly polarized radiation field when radiating layer 160 is driven at frequency 174. Although peak gain is marginally sacrificed, circular polarity can be achieved with a simpler antenna feed structure than many conventional micro strip antennas.

In some embodiments, circular polarity is achieved only in a narrow bandwidth. Outside of the narrow bandwidth, circular polarity can significantly degrade. Low out-of-band interference gain mitigates unintentional interference. In other words, the antenna can be less sensitive to signals (e.g., jamming signals) that are outside of the narrow bandwidth.

Embodiments such as that of FIG. 1C in which the feed pin is located along a radial line that is positive 45 degrees from the radial line of shunted stub 118 in plan view can generate right-hand circular polarization. Embodiments in which the feed pin is located along a radial line that is negative 45 degrees from the radial line of shunted stub 118 in plan view can generate left-hand circular polarization.

Figure 1E:
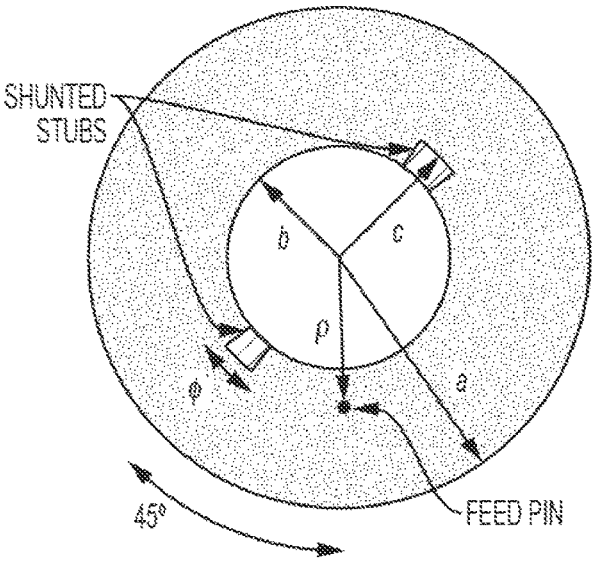
FIG. 1E is a top view of a SAR antenna with shunted stubs to create circular polarization with a single feed, according to some embodiments.

According to some embodiments and without being bound by any theory, the introduction of shunted stubs can provide circular polarization according to the following relationships. FIG. 1E provides a simplified representation of the antenna of FIG. 1C. The perturbation segment, Δs, extends the effective inner radius of the shorted annular ring. The height of the shunted stub, h, is not taken into account, as it is assumed that the antenna cavity height is electrically small and the fields in the vertical direction are constant. The perturbation segment is derived as $$\Delta s = (c-b)\int_0^{\Phi'/2} \cos\phi \, d\phi \tag{1}$$

where $$\Phi' = \phi' + \frac{2(c-b)}{c} \tag{2}$$

The units of the stub angular width, ϕ', in (2) are radians. Equation (1) defines an effective inner radius of the antenna when the feed is aligned with the stub as shown in FIG. 1A. Since the vertical electric fields, $E_z$, for $TM_{11}$ mode of the antenna are proportional to cos ϕ, where ϕ=0° is the location of the feed pin, the cumulative contribution of the stub falls off with the cosine of its angular width. The second term on the right-hand side of (2) accounts for the fringing fields around the stub, which makes the effective stub width larger than its physical width.

Since $E_z$ for $TM_{11}$ mode of the antenna is proportional to cos ϕ, the field strength is negligible at ϕ=90° from the feed. If the shunted stub is sufficiently thin, the stub may not affect the resonant frequency when it is located at ϕ=90°, as shown in FIG. 1B, because it does not perturb the field distribution. In this way, the effective inner radius of the antenna can produce a different resonance when the feed is aligned with one of the stubs compared to when the feed is offset by 90° from the stubs.

When the shunted stubs are located at ϕ=±45° and ±225°, as shown in FIG. 1C, two orthogonal modes are excited. One of the modes has a resonance defined by the antenna inner radius, b, while the other mode has a resonance defined by the effective inner radius created by the shunted stubs, c. These two orthogonal modes can be equal in amplitude and in quadrature at an intermediate frequency between the two resonances, creating the condition for circular polarization.

The antenna resonant frequency is given by:

$$f_{mn} = \frac{k_{mn} c_0}{2\pi a_{eff}\sqrt{\varepsilon_r}} \tag{3}$$

where $c_0$ is the speed of light, $\varepsilon_r$ is the substrate relative permittivity, and $k_{mn}$ are the roots of the characteristic equation:

$$J'_m(k_{mn})N_m\left(k_{mn}\frac{b_{eff}}{a_{eff}}\right) - J_m\left(k_{mn}\frac{b_{eff}}{a_{eff}}\right)N'_m(k_{mn}) = 0 \tag{4}$$

In (4), $J_m$ and $N_m$ are the mth order Bessel functions of the first and second kind respectively and the prime denotes the first derivative. The characteristic equation (4) is derived from the boundary conditions of the antenna. The dimension $a_{eff}$ is a correction value of the outer radiating layer radius accounting for the fringing fields, which is:

$$a_{eff} = a + \kappa h \tag{5}$$

The constant κ in (5) may be 0.75 for an antenna with a dielectric substrate that extends beyond the top patch in the planar dimension to the edge of the ground plane. In some embodiments with a substrate that ends at the edge of the patch, constant κ may be 0.5. The dimension $b_{eff}$ in (4) may be equivalent to b when the thin shunted stubs are ±90° from the feed pin (i.e. when the stubs do not affect the fields in the antenna). When the shunted stubs are aligned with the feed pin, $b_{eff}$ may be the effective inner radius of the antenna, given by $$b_{eff}=b+\Delta s \tag{6}$$

Figure 1F:
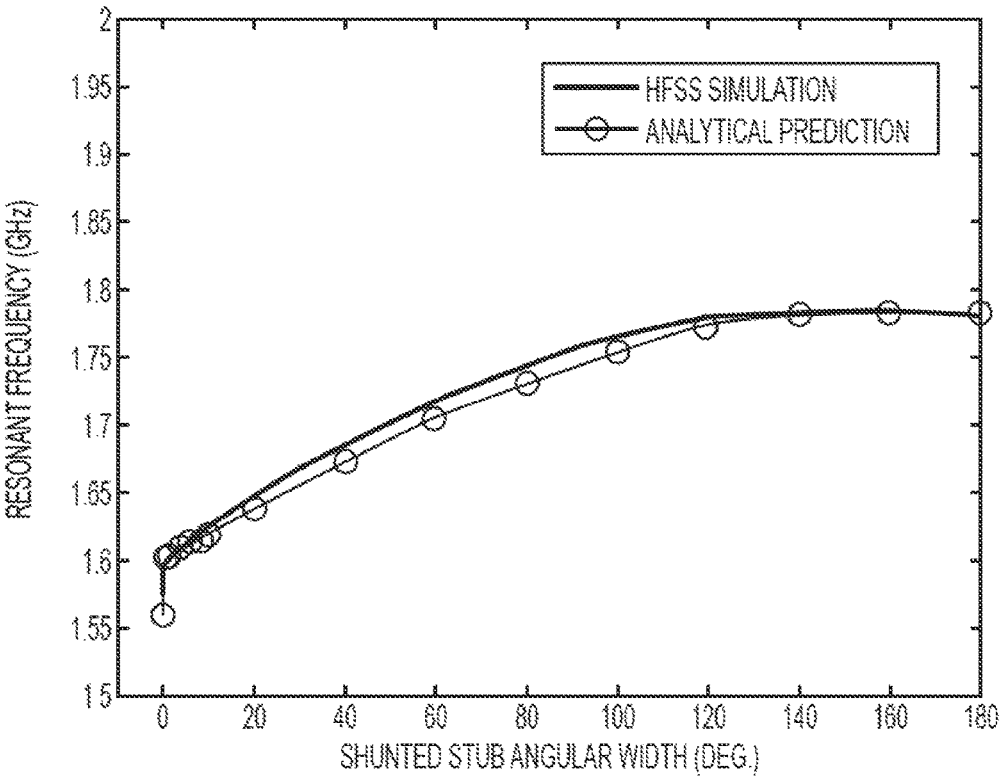
FIG. 1F is a comparison of simulated and analytically derived resonance vs. shunted stub angular width for some embodiments of the antenna of FIG. 1A.

According to some embodiments, an antenna was simulated in the configuration shown in FIG. 1A with HFSS, a full-wave finite element solver. The angular width of the shunted stub, ϕ', was varied from 0° to 180° while all other dimensions remained constant. The simulated antenna has an outer annular radius of 2.422 inches and an inner annular radius of 1.276 inches. The height of the substrate is 0.125 inches, the dielectric constant of the substrate is 2.2 (Rogers 5880), the ground plane radius is 3.5 inches, and the feed pin location is 1.7 inches from the center of the antenna. FIG. 1F shows that the simulated resonant frequency is in good agreement with the predicted resonance of Equations (1)-(6).

Figure 1G:
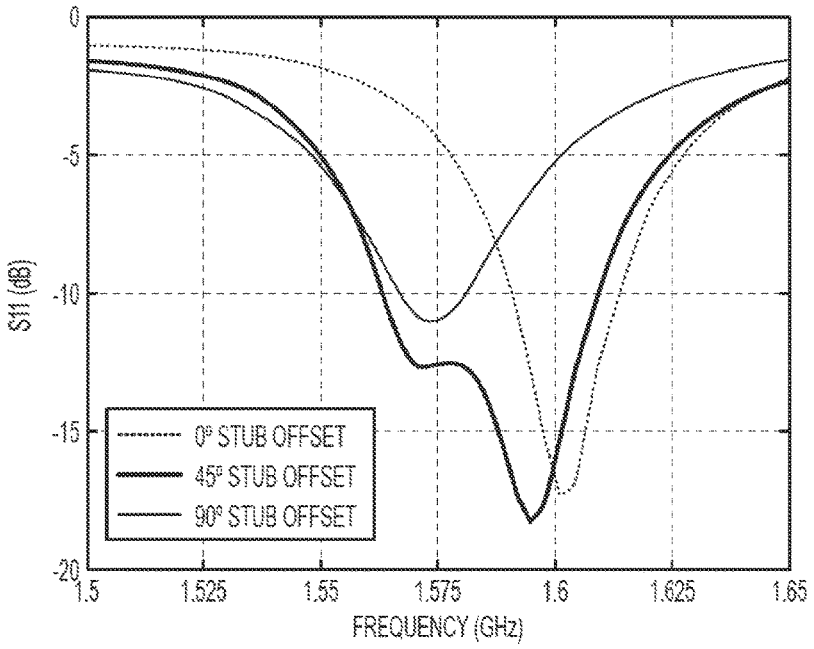
FIG. 1G illustrates simulated reflection coefficients for a SAR antenna with shunted stubs offset 0°, 45°, and 90° from the feed, according to some embodiments.
Figure 1H:
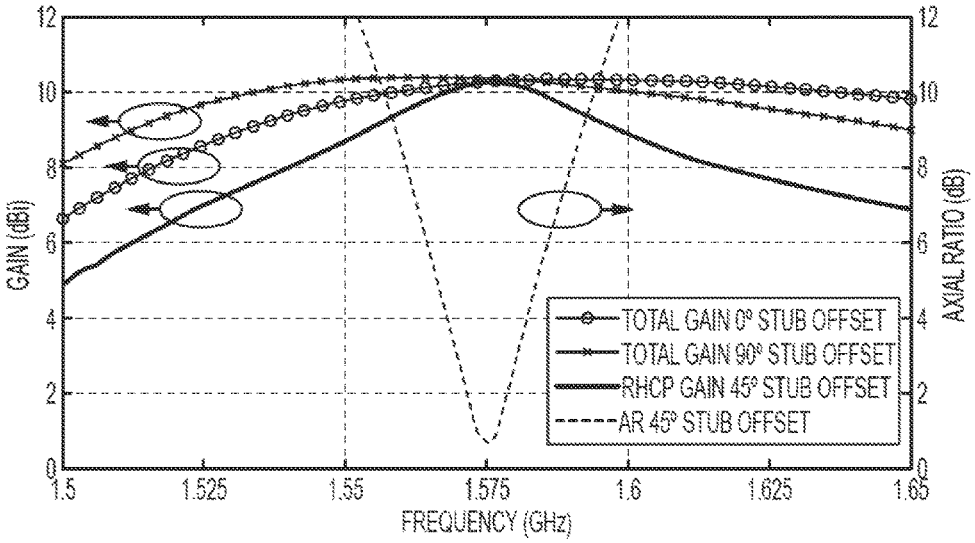
FIG. 1H illustrates simulated gain for a SAR antenna with shunted stubs offset 0°, 45°, and 90° from the feed compared to the axial ratio for a 45° stub offset, according to some embodiments.

When the shunted stubs are offset from the feed by 45°, as shown in FIG. 1C, circular polarization is achieved between the resonant frequencies for the case of the shunted stubs offset by ±90° from the feed (lower frequency resonance) and the case of the shunted stubs aligned with the feed (higher frequency resonance). In order to demonstrate that circular polarization is achieved at the intermediate frequency, the antenna was simulated with 1.6° wide shunted stubs offset by 0°, 45°, and 90° from the feed. FIG. 1G shows the reflection coefficient for the antenna with three different stub offsets. It can be seen that the resonant frequency is highest when the stubs are aligned with the feed and the resonant frequency is lowest when the stubs are offset by 90°. It can also be seen that when the stubs are offset by 45°, energy is dissipated in both modes. That is, the reflection coefficient has a broader response. This is not to say that circular polarization is achieved over this entire band. On the contrary, FIG. 1H shows the gain of the antenna with the three stub offsets. The axial ratio for the 45° stub offset is also included in FIG. 1H for comparison to the orthogonal mode gain crossover. It can be seen that the axial ratio is optimized when the amplitudes of the orthogonal modes are equal and it falls off rapidly away from the crossover frequency. The simulated axial ratio reaches 0.6 dB at the L1 GPS center frequency and is less than 5.5 dB within the operational bandwidth, which can be sufficient for GPS timing applications. The narrow band axial ratio can be considered to offer out-of-band rejection for RHCP signals compared to antennas with a good axial ratio over a broader band.

Single-Band Antenna with Vias

Figure 2B:
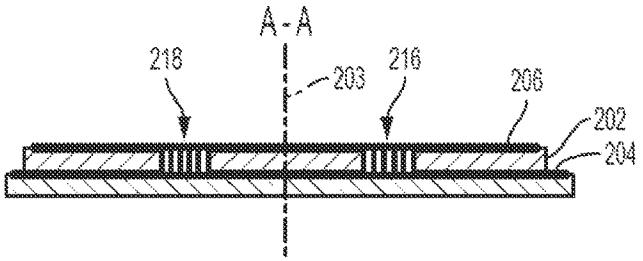
FIG. 2B is a cross-sectional view through cross-section A-A of FIG. 2A, according to some embodiments.
Figure 2C:
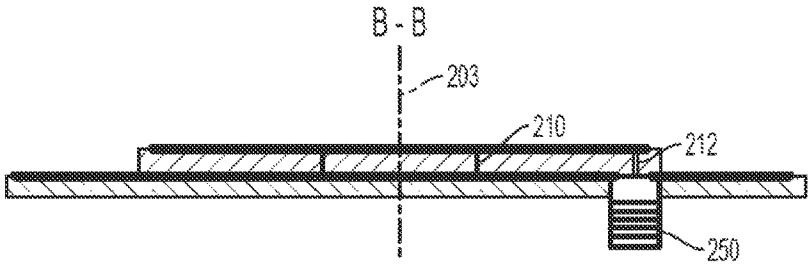
FIG. 2C is a cross-sectional view through cross-section B-B of FIG. 2A, according to some embodiments.
Figure 2A:
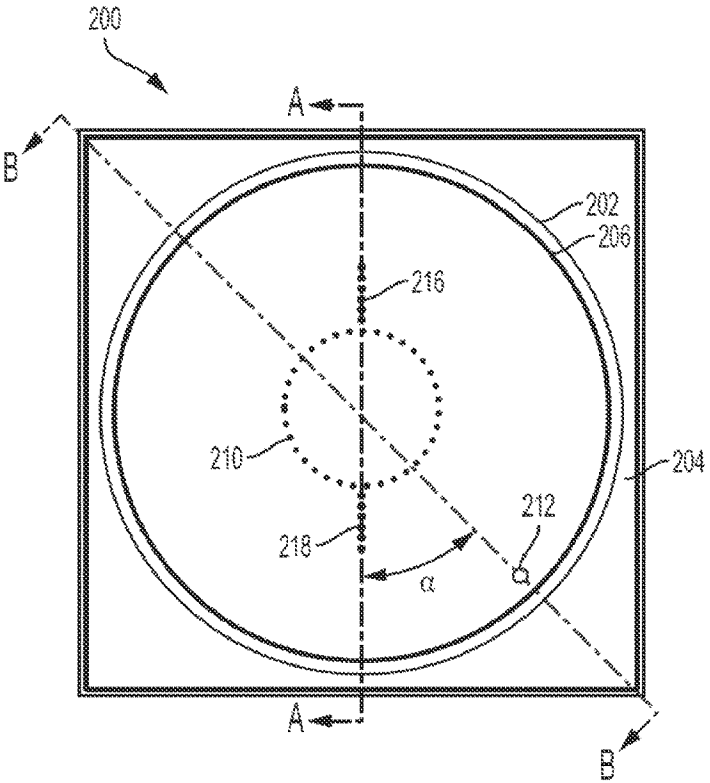
FIG. 2A is a plan view of a single-band SAR antenna with shunted stubs, according to some embodiments.

FIGS. 2A-2C illustrate microstrip patch antenna 200 configured to generate a circularly polarized radiation field through input to a single feed port in accordance with some embodiments. FIG. 2A is a plan view of the antenna, FIG. 2B is a cross-sectional view through line A-A of FIG. 2A, and FIG. 2C is a cross-sectional view through line B-B of FIG. 2A. Antenna 200 includes a shorting ring and shunted stubs formed by a plurality of metal-plated vias allowing antenna 200 to be manufactured with low-cost PCB manufacturing techniques. Antenna 200 includes substrate 202 with ground plane 204 disposed on a first side and radiating layer 206 disposed on a second side. Shorting ring 210 extends from ground plane 204 to radiating layer 206. Extending radially from shorting ring 210 are two shunted pathways, 216 and 218, that electrically connect radiating layer 206 to ground plane 204. Feed conductor 212 extends from radiating layer 206, through substrate 202 and ground plane 204, to connect to feed connector 250, which is configured to connect to a feed line for feeding a signal to the antenna.

Feed conductor 212 is located at a distance from shorting ring 210 along a first radial line. Shunted pathway 218 extends along a second radial line from shorting ring 210. Shunted pathway 216 extends along a third radial line from shorting ring 210, which is generally collinear with the second radial line such that the second and third radial lines are about 180 degrees apart. The second radial line (of shunted pathway 218) and the first radial line (of feed conductor 212) form angle α between them. By configuring the antenna with angle α equal to about 45 degrees counterclockwise relative to the shunted pathway when looking from above (as in FIG. 2), the antenna can generate a circularly polarized (specifically, right-hand circularly polarized) radiation field in response to a signal received through feed conductor 212 alone. In other words, no additional feed ports are required to generate a circularly polarized radiation field. In some embodiments, circular polarization is achieved with a configured as an acute angle (i.e., less than 90 degrees). According to some embodiments, circular polarization is achieved at α less than 80 degrees, less than 60 degrees, less than 50 degrees, and less than 40 degrees. According to some embodiments, circular polarization is achieved at α less than 49 degrees, less than 48 degrees, less than 47 degrees, and less than 46 degrees. According to some embodiments, circular polarization is achieved at α greater than 0 degrees, greater than 10 degrees, greater than 20 degrees, greater than 30 degrees, greater than 40 degrees, and greater than 50 degrees. According to some embodiments, circular polarization is achieved at α greater than 41 degrees, greater than 42 degrees, greater than 43 degrees, and greater than 44 degrees.

Shorting ring 210 is a conductive pathway (or set of conductive pathways) that extends from ground plane 204 to radiating layer 206. Shorting ring 210 forms a ring about axis 203 that is substantially perpendicular to the antenna (i.e., perpendicular to the radiating layers). In some embodiments, the ring may be concentric with a circular radiating layer 206.

Shorting ring 210 can be formed from metal-plated vias (e.g., plated through-holes) that extend from ground plane 204 through the thickness of substrate 202 to radiating layer 206. In some embodiments, the vias are equally spaced along the ring. In some embodiments, vias are spaced at less than or equal to one-fiftieth the center radiating frequency wavelength (λ) (from the center of one vias to the center of the next vias). Vias may have greater spacing, for example, more than 1/50 λ, more than 1/10 λ, or more than 1/5 λ. Vias may have less spacing, for example, less than 1/60 λ, less than 1/80 λ, less than 1/100 λ, less than 1/200 λ, and so on. In some embodiments, via spacing is determined by minimum via diameter. For example, via diameters in some embodiments may be 0.020 inches and via spacing is greater than 0.020 inches. Other via diameters, according to some embodiments, are greater than 0.001 inches, greater than 0.005 inches, greater than 0.010 inches, greater than 0.015 inches, etc. Smaller via diameters may be achieved using laser-based boring methods at the expense of increased cost. Larger, but less costly, vias can be achieved using drilling methods.

In some embodiments, radiating layer 206 is an unbroken circle of conductive material (i.e., the inner portion within shorting ring 210 is also formed of conductive material). In some embodiments, the inner portion of radiating layer 206, inside shorting ring 210, does not include conductive material. In some embodiments, instead of vias, the shorting ring is a continuous wall of metal plating. For example, a bore may be formed in substrate 202 and radiating layer 206, and the inner surface of the hole may include metal plating electrically connecting radiating layer 206 to ground plane 204.

Shunted pathways 216 and 218 are conductive pathways (or sets of conductive pathways) that also extend from ground plane 204 to radiating layer 206. Each pathway is disposed along a respective line extending outwardly from shorting ring 210. In some embodiments, the line of pathway 216 is substantially collinear with the line of pathway 218. In some embodiments, one or more pathway lines are collinear with a line extending to the center of shorting ring 210 (i.e., collinear with a radial line of a circular radiating layer).

Shunted pathways 216 and 218 can be formed from metal vias that extend from ground plane 204 through the thickness of substrate 202 to radiating layer 206. Similarly to shorting ring 210, these holes may be closely spaced. Spacing may be determined by the operating center frequency and/or by minimum achievable via diameter, as discussed above with respect to shorting ring 210. In some embodiments, instead of vias, slots are formed into the substrate and the slots are metal plated.

Feed conductor 212 extends through ground plane 204 and substrate 202 to radiating layer 206. According to some embodiments, feed conductor 212 is electrically connected to other portions of radiating layer 206. In some embodiments, feed conductor 212 is not electrically connected to other portions of radiating layer 206 (i.e., the feed conductor separated from the rest of the conductive layer by an insulating ring). Feed conductor 212 is electrically insulated from ground plane 204. According to some embodiments, feed conductor 212 can be a solid conductor, such as a copper wire, that extends through a bore in substrate 202. According to some embodiments, feed conductor 212 is a metal-plated via. In some embodiments, feed conductor 212 includes a metal-plated via with a solid conductive wire extending at least partially through, for example, a center conductor of a coaxial connector. Feed conductor 212 may be connected to a signal conductor of feed connector 250. Feed connector 250 is configured to connect a feed line to antenna 200. Feed connector 250 may electrically connect a ground conductor of a feed line to the ground plane and a signal conductor of the feed line to feed conductor 212.

According to some embodiments, feed conductor 212 is positioned to provide impedance matching between an input and radiating layer 206. As is known in the art, impedance refers, in the present context, to the ratio of the time-averaged value of voltage and current in a given section of the antenna. This ratio, and thus the impedance of each section, depends on the geometrical and material properties of the signal path of the antenna. If an antenna is interconnected with a transmission line having different impedance, the difference in impedances ("impedance step" or "impedance mismatch") causes a partial reflection of a signal traveling through the transmission line and antenna. The same can occur between the radiating layer and free space. "Impedance matching" is a process for reducing or eliminating such partial signal reflections by matching the impedance of a section of the antenna to an adjoining section or transmission line. As such, impedance matching establishes a condition for maximum power transfer at such junctions. "Impedance transformation" is a process of gradually transforming the impedance of the radiating element from a first matched impedance at one end (e.g., the transmission line connecting end) to a second matched impedance at the opposite end (e.g., the free space end).

According to certain embodiments, a transmission feed line provides the antenna with excitation signals. The transmission feed line may be a specialized cable designed to carry alternating current of radio frequency. In certain embodiments, the transmission feed line may have an impedance of 50 ohms. In certain embodiments, when the transmission feed line is excited, the characteristic impedance of the transmission feed lines may also be 50 ohms. As understood by one of ordinary skill in the art, it is desirable to design a radiating element to perform impedance transformation from this 50 ohm impedance (an assumed or ideal impedance of a transmission feed line or assembly) into the antenna at the connector (e.g., feed connector 250 in FIG. 2C, to the impedance of the radiating layer at the location of the feed conductor in the radiating layer). Generally, the input impedance increases from a minimum at the center of the radiating layer to a maximum at the perimeter. For example, where the feed structure, which includes the feed conductor, transforms 50 ohm input impedance to 100 ohm impedance at the radiating layer, the feed conductor may be located at a radial position corresponding to 100 ohm impedance of the radiating layer. Other feed line impedances are also possible, such as less than 100 ohms, less than 150 ohms, less than 300 ohms, and so on.

In some embodiments, ground plane 204 is a metal plate providing both grounding and structural strength to the antenna. In some embodiments, ground plane 204 is a thin layer of metal deposited on a base-plate, such as a dielectric substrate material. The base-plate can provide structural rigidity with lower weight than a metallic base-plate.

The frequency response, radiation patterns, and polarization characteristics of antenna 200 can be "tailored" by selecting appropriate design parameters, including the outer diameter of the radiating layer, the diameter of the shorting ring, the thickness of the radiating layer, the thickness and dielectric constant of the dielectric substrate, the selection of the feed conductor, the shunt stub size, and so on. This flexibility in design allows antenna 200 to be used in numerous applications.

In some embodiments, antenna 200 can provide anti-jamming capability by including a "null" at the antenna's horizon. The antenna can be configured such that the antenna gain is at a minimum near+/−90 degrees elevation (with zero degree elevation being orthogonal to the radiating layer). The signal strength of ground-based signals will be undetectable or very weak relative to the signal strength of signals received orthogonally to the antenna as a result of placing the null at the horizon. In some embodiments, the antenna can be configured with a null at the horizon by adjusting the outer diameter of the radiating layer. As will be appreciated by a person of ordinary skill in the art, the null can be placed at elevations other than horizon by adjusting one or more design parameters (e.g., by adjusting the outer diameter of the radiating layer).

In some embodiments, the radiating field characteristics can be improved by including a second feed line positioned 180 degrees from feed conductor 212. In operation, the second feed line is fed by a signal that is 180 degrees out of phase relative to the signal feeding feed conductor 212. By including a second feed line, the radiating field can be more uniform around the azimuth.

Dual-Band Antenna with Vias

Figure 3B:
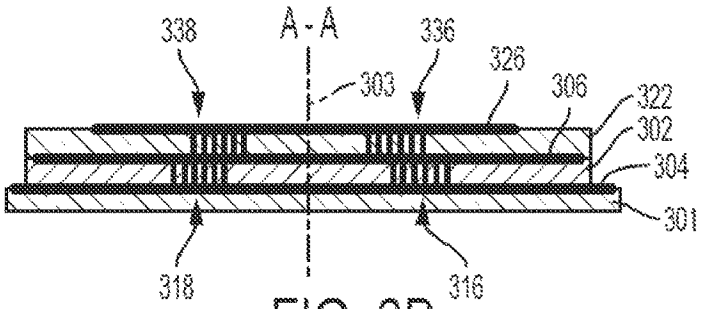
FIG. 3B is a cross-sectional view through cross-section A-A of FIG. 3A, according to some embodiments.
Figure 3C:
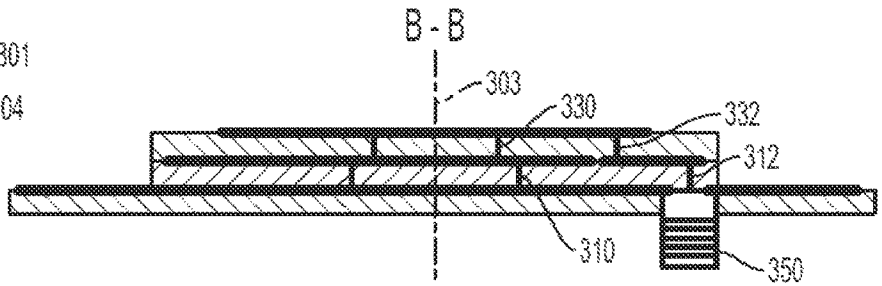
FIG. 3C is a cross-sectional view through cross-section B-B of FIG. 3A, according to some embodiments.
Figure 3A:
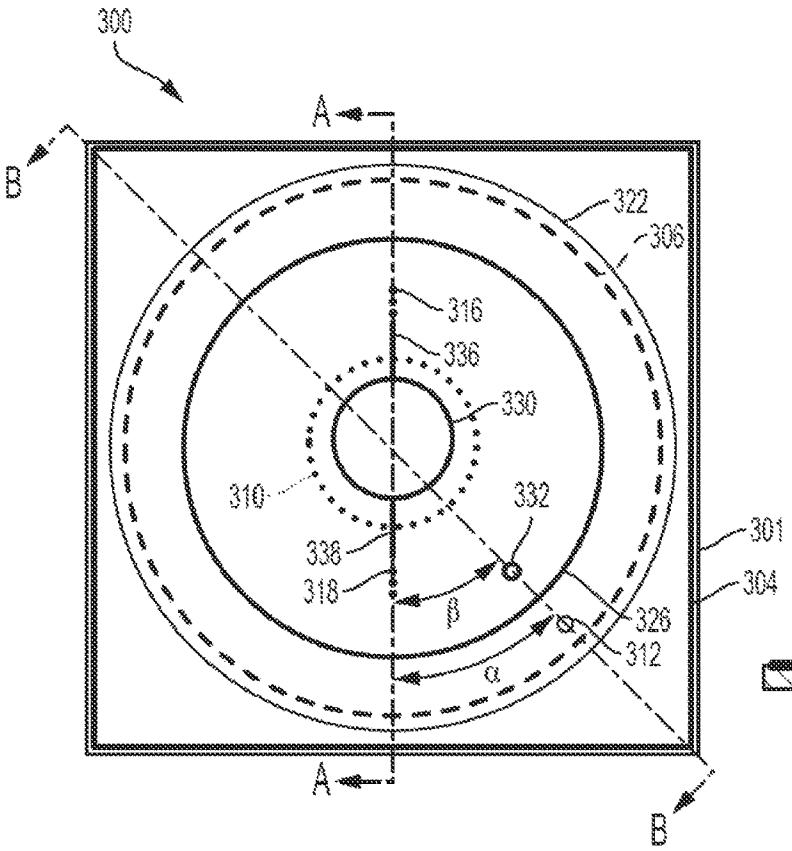
FIG. 3A is a plan view of a dual-band SAR antenna with shunted stubs, according to some embodiments.
Figure 3D:
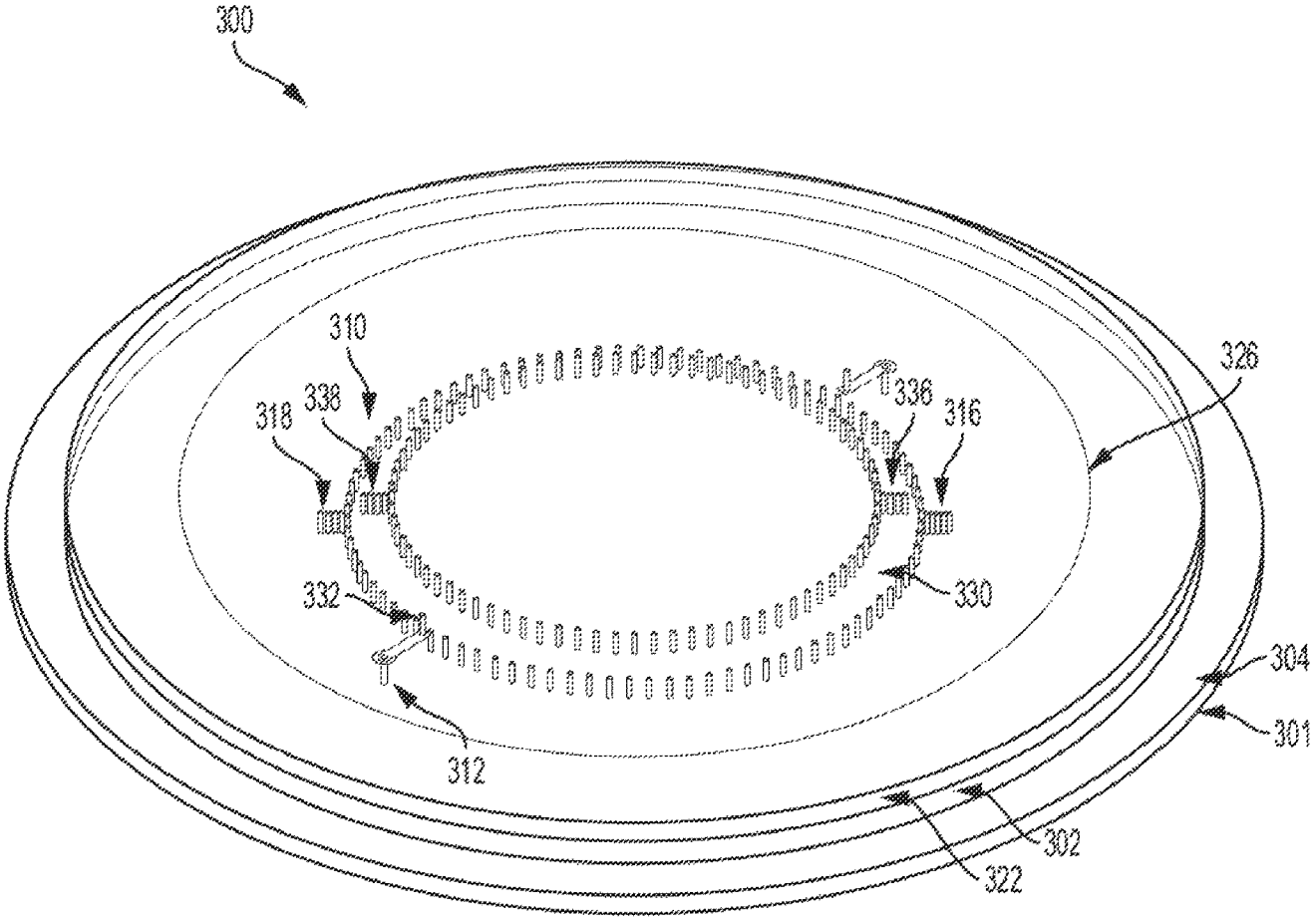
FIG. 3D is a perspective view of the dual-band SAR antenna of FIGS. 3A-3C, according to some embodiments.

FIGS. 3A-3D illustrate microstrip patch antenna 300 configured to generate circularly polarized radiation fields for two frequency bands through input to a single feed port in accordance with some embodiments. FIG. 3A is a plan view of the antenna, FIG. 3B is a cross-sectional view through line A-A of FIG. 3A, FIG. 3C is a cross-sectional view through line B-B of FIG. 3A, and FIG. 3D is a perspective view. Antenna 300 includes two stacked radiators configured to resonate at different frequencies. Antenna 300 may be configured for dual-band GPS operation with one radiator configured to operate in the L1 band (20 MHz band centered about 1575.42 MHz) and the other layer configured to operate in the L2 band (20 MHz band centered about 1227.60 MHz). Antenna 300 is similar to the single-band antenna 200 of FIG. 2, but with a second radiating layer stacked above the first radiating layer by a second substrate. The first radiating layer acts as the ground plane for the second radiating layer, thus forming the second radiator. For the second radiator, the size of the radiating layer, diameter of the shorting ring, location of the feed conductor, and length of the shunted stubs can be tailored independently of that of the first radiator for operation at a second frequency band.

Antenna 300 includes a first radiator formed of ground plane 304, first substrate 302, and first radiating layer 306, and a second radiator formed of first radiating layer 306 (which can function as a ground plane at the resonant frequency of the second radiator), second substrate 322, and second radiating layer 326, in a stacked configuration, as illustrated in FIGS. 3B-3D. In some embodiments, ground plane 304 is a thin metallic layer deposited on a base-plate, as shown in FIGS. 3A-3C. In some embodiments, the ground plane provides grounding and structural rigidity (e.g., the ground plane is a metal plate).

The first radiator of antenna 300 includes shorting ring 310, which extends from ground plane 304 to radiating layer 306. Extending radially from shorting ring 310 are two shunted pathways, 316 and 318, that electrically connect radiating layer 306 to ground plane 304. Feed conductor 312 extends from radiating layer 306, through substrate 302 and ground plane 304, to connect to feed connector 350, which is configured to connect to a feed line for feeding a signal to the antenna.

Feed conductor 312 is located at a distance from shorting ring 310 along a first radial line. Shunted pathway 318 extends along a second radial line from shorting ring 310. Shunted pathway 316 extends along a third radial line from shorting ring 310, which is generally collinear with the second radial line such that the second and third radial lines are about 180 degrees apart. The second radial line (of shunted pathway 318) and the first radial line (of feed conductor 312) form angle $\alpha$ between them. By configuring the antenna with angle $\alpha$ equal to about 45 degrees, the antenna can generate a circularly polarized radiation field, corresponding to a resonance of the first radiator, in response to a signal received through feed conductor 312 alone. In some embodiments, circular polarization is achieved with a configured as an acute angle (i.e., less than 90 degrees). According to some embodiments, circular polarization is achieved at $\alpha$ less than 80 degrees, less than 60 degrees, less than 50 degrees, and less than 40 degrees. According to some embodiments, circular polarization is achieved at $\alpha$ less than 49 degrees, less than 48 degrees, less than 47 degrees, and less than 46 degrees. According to some embodiments, circular polarization is achieved at $\alpha$ greater than 0 degrees, greater than 10 degrees, greater than 20 degrees, greater than 30 degrees, greater than 40 degrees, and greater than 50 degrees. According to some embodiments, circular polarization is achieved at $\alpha$ greater than 41 degrees, greater than 42 degrees, greater than 43 degrees, and greater than 44 degrees.

Shorting ring 310 is a conductive pathway (or set of conductive pathways) that extends from ground plane 304 to radiating layer 306. Shorting ring 310 forms a ring about axis 303 that is substantially perpendicular to the antenna (i.e., perpendicular to the radiating layers). In some embodiments, the ring may be concentric with circular radiating layer 306.

Shorting ring 310 can be formed from metal-plated vias (e.g., plated through-holes) that extend from ground plane 304 through the thickness of substrate 302 to radiating layer 306. In some embodiments, the vias are equally spaced along the ring. In some embodiments, vias are spaced at one-fiftieth the center radiating frequency wavelength (from the center of one via to the center of the next via). In some embodiments, radiating layer 306 is an unbroken circle of conductive material (i.e., the inner portion within shorting ring 310 is also formed of conductive material). In some embodiments, the inner portion of radiating layer 306, inside shorting ring 310, does not include conductive material. In some embodiments, instead of vias, the shorting ring is a continuous wall of metal plating. For example, a bore may be formed in substrate 302 and radiating layer 306, and the inner surface of the hole may include metal plating electrically connecting radiating layer 306 to ground plane 304.

Shunted pathways 316 and 318 can be formed from metal vias that extend from ground plane 304 through the thickness of substrate 302 to radiating layer 306. Similarly to shorting ring 310, these holes may be closely spaced. In some embodiments, instead of vias, slots are formed into the substrate and the slot is metal plated.

Feed conductor 312 extends through ground plane 304 and substrate 302 to radiating layer 306. In some embodiments, feed conductor 312 is not electrically connected to other portions of radiating layer 306 (i.e., the feed conductor separated from the rest of the conductive layer by an insulating ring). Feed conductor 312 is electrically insulated from ground plane 104. Feed conductor 312 may be connected to a signal conductor of feed connector 350. Feed connector 350 is configured to connect a feed line to antenna 300. Feed connector 350 may electrically connect a ground conductor of a feed line to the ground plane and a signal conductor of the feed line to feed conductor 312.

According to some embodiments, feed conductor 312 is positioned to provide impedance matching between an input and radiating layer 306, for example, in the manner discussed above with respect to feed conductor 212 of FIG. 2.

As stated above, antenna 300 includes a second radiator, for operating in a second frequency band, formed of second substrate 322 stacked atop first radiating layer 306 (which can function as a ground plane at the resonant frequency of the second radiator), and with second radiating layer 326 stacked atop substrate 322. The second radiator also includes shorting ring 330, which extends from first radiating layer 306 to second radiating layer 326. Extending radially from shorting ring 330 are two shunted pathways, 336 and 338, that electrically connect second radiating layer 326 to first radiating layer 306. Feed conductor 332 extends from second radiating layer 326, through substrate 322 to first radiating layer 306. A conducting strip within first radiating layer 306 electrically connects feed conductor 332 with feed conductor 312, as is discussed in more detail below.

Feed conductor 332 is located at a distance from shorting ring 330 along a first radial line. Shunted pathway 338 extends along a second radial line from shorting ring 330. Shunted pathway 336 extends along a third radial line from shorting ring 330, which is generally collinear with the second radial line such that the second and third radial lines are about 180 degrees apart. The second radial line (of shunted pathway 338) and the first radial line (of feed conductor 332) form angle β between them. By configuring the antenna with angle β equal to about 45 degrees, the antenna can generate a circularly polarized radiation field, corresponding to a resonance of the first radiator, in response to a signal received through feed conductor 332 alone. In some embodiments, circular polarization is achieved with β configured as an acute angle (i.e., less than 90 degrees). According to some embodiments, circular polarization is achieved at β less than 80 degrees, less than 60 degrees, less than 50 degrees, and less than 40 degrees. According to some embodiments, circular polarization is achieved at β less than 49 degrees, less than 48 degrees, less than 47 degrees, and less than 46 degrees. According to some embodiments, circular polarization is achieved at β greater than 0 degrees, greater than 10 degrees, greater than 20 degrees, greater than 30 degrees, greater than 40 degrees, and greater than 50 degrees. According to some embodiments, circular polarization is achieved at β greater than 41 degrees, greater than 42 degrees, greater than 43 degrees, and greater than 44 degrees. In some embodiments, β is substantially the same as α, and in other embodiments, they are different.

In the embodiment of FIGS. 3A-3D, the shunted pathways (336 and 338) and feed conductor (332) are in line with the shunted pathways and feed conductor of the first radiator. However, in some embodiments, the locations of these features in one layer do not correspond to the locations of similar features in other layers.

Shorting ring 330 is a conductive pathway (or set of conductive pathways) that extends from first radiating layer 306 to second radiating layer 326. Shorting ring 330 forms a ring about an axis that is substantially perpendicular to the antenna (i.e., perpendicular to the radiating layers). For example, the axis may be axis 303. In some embodiments, the ring may be concentric with circular radiating layer 326.

Shorting ring 330 can be formed from metal-plated vias (e.g., plated through-holes) that extend from first radiating layer 306 through the thickness of substrate 322 to second radiating layer 326. In some embodiments, the vias are equally spaced along the ring. In some embodiments, vias are spaced at one-fiftieth the center radiating frequency wavelength of the second radiator (from the center of one via to the center of the next via). In some embodiments, radiating layer 326 is an unbroken circle of conductive material (i.e., the inner portion within shorting ring 330 is also formed of conductive material). In some embodiments, the inner portion of radiating layer 326, inside shorting ring 330, does not include conductive material. In some embodiments, instead of vias, the shorting ring is a continuous wall of metal plating, such as copper tape. For example, a bore may be formed in substrate 322 and second radiating layer 326, and the inner surface of the hole may include metal plating electrically connecting second radiating layer 326 to first radiating layer 306.

Shunted pathways 336 and 338 can be formed from metal vias that extend from first radiating layer 306 through the thickness of substrate 322 to second radiating layer 326. Similarly to shorting ring 330, these vias may be closely spaced. In some embodiments, instead of vias, slots are formed into the substrate and the slot is metal plated.

Feed conductor 332 extends from first radiating layer 306 through substrate 322 to second radiating layer 326. In some embodiments, feed conductor 332 is electrically connected to the rest of second radiating layer 326. In some embodiments, feed conductor 332 is not electrically connected to other portions of radiating layer 326 (i.e., the feed conductor separated from the rest of the conductive layer by an insulating ring). Feed conductor 332 is electrically insulated from first radiating layer 306. According to some embodiments, feed conductor 332 can be a metal-plated via. In some embodiments, feed conductor 332 can be a solid conductive wire (for example, extending through the lower layers of the antenna). In some embodiments, feed conductor 332 can be a combination of a metal-plated via with a solid conductor in the center.

According to some embodiments, feed conductor 332 is positioned to provide impedance matching between an input and second radiating layer 326, according to the principles discussed above with respect to feed conductor 212 of FIG. 2. In some embodiments, feed conductor 332 can be positioned to provide impedance matching to the impedance of feed conductor 332 at its distal end (the end terminating in second radiating layer 326). The optimized location for impedance matching may be different than that for the first radiator, and thus feed conductor 332 may be located at a different radial location, as shown in FIG. 3.

In some embodiments, feed conductor 332 can be optimally located based on the location of feed conductor 312 of the first radiator. For example, where the impedance of feed conductor 312 at the location in first radiating layer 306 is 100 ohm, feed conductor 332 can be located at radial location of second radiating layer 326 with impedance equal to 100 ohm at the resonant frequency of the second radiator. This radial location may be different than that of the first radiator. As mentioned above and explained in more detail below, in the section describing a coplanar waveguide transition, a conductive strip within the first radiating layer 306 can electrically connect feed conductor 332 with feed conductor 312. Thus, an excitation signal at a frequency corresponding to the resonant frequency of the second radiator may travel from a feed line through feed connector 350, through feed conductor 312, through the conducting strip, and through feed conductor 332 to second radiating layer 326. Because the first radiator is not configured to resonate at the same frequency as the second radiator, power is not radiated prior to second radiating layer 326. In some embodiments, the diameters of feed conductor 332 and feed conductor 312 can be independently selected to achieve desired performance (such as impedance matching). In some embodiments, the diameters are different, while in other embodiments, the diameters are the same.

In some embodiments, a single feed conductor is used to feed both radiators. The single feed conductor may extend from a feed connector, through all the layers, to the second radiating layer. In these embodiments, the radial location of the single feed conductor can be a compromise between impedance matching to the first radiator and impedance matching to the second radiator, as is known in the art.

In some embodiments, antenna 300 can provide anti-jamming capability for each of the two bands by including a "null" at the antenna's horizon in each band. The first radiator can be configured such that the gain of the first frequency band is at a minimum near+/−90 degrees elevation (with zero degree elevation being orthogonal to the radiating layer). The signal strength of ground-based signals will be undetectable or very weak relative to the signal strength of signals received orthogonally to the antenna as a result of placing the null at the horizon. In some embodiments, the second radiating layer can also be configured with a null at the horizon by adjusting the outer diameter of the second radiating layer. The second radiator can be configured such that the gain of the second frequency band is at a minimum near+/−90 degrees elevation (with zero degree elevation being orthogonal to the radiating layer). In some embodiments, the second radiating layer can be configured with a null at the horizon by adjusting the outer diameter of the first radiating layer.

In some embodiments, as shown in FIG. 3D, antenna 300 can include a second feed connector and second feed conductors spaced 180 degrees relative to the respective first feed connector (350) and first feed conductors (312 and 332). In operation, the second feed set is driven with a signal 180 degrees out of phase relative to a signal driving the first feed set. This can help improve radiating field symmetry about the azimuth.

The frequency response, radiation patterns, and polarization characteristics of each radiator of antenna 300 can be independently tailored by selecting appropriate design parameters, including the outer diameters of the radiating layers, the diameters of the shorting rings, the thicknesses of the radiating layers, the thicknesses and dielectric constants of the dielectric substrates, the location of the feed conductors, and so on, according to design principles known in the art. For example, certain dimensional parameters typically scale by wavelength (e.g., one quarter of a wavelength) of the center frequency for a desired operating frequency band. Thus, the antennas described herein can be tailored to any desired operating frequencies by scaling the design. According to certain embodiments, values are scaled up or down for a desired frequency bandwidth. For example, radiators designed for lower frequencies are scaled up (larger dimensions) and radiators designed for higher frequencies are scaled down (smaller dimensions). This flexibility in design allows the antennas herein, including antenna 300, to be used in numerous applications. Moreover, the principle of stacking multiple radiators, as explained with respect to antenna 300, can be extended to include multi-band operation that includes more than two bands. For example, according to some embodiments, three-band operation can be enabled through three layers of radiators, four-band operation can be enabled through four layers of radiators, and so on.

According to some embodiments, a dual-band antenna is configured to operate in the GPS L1 and L2 bands. A first radiator (lower radiator just above the ground plane, hereinafter "L2 radiator") can be configured to operate in the L2 band and a second radiator (upper radiator stacked above the first radiator, hereinafter "L1 radiator") can be configured to operate in the L1 band. It should be noted that these layers can be switched without departing from the design parameters provided below.

The L1 radiator can have an outer radiating layer diameter (e.g., radiating layer 326) of about 4.844 inches and a shorting ring diameter (e.g., shorting ring 330) of about 2.665 inches. The length of each shunted pathway (e.g., shunted pathways 336 and 338) can be about 0.168 inches (measured from the shorting ring to the last via). The radial distance to the L1 radiator feed conductor (e.g., feed conductor 332) can be about 1.62 inches.

The L2 radiator can have an outer radiating layer diameter (e.g., radiating layer 306) of about 5.872 inches and a shorting ring diameter (e.g., shorting ring 310) of about 2.958 inches. The length of each shunted pathway (e.g., shunted pathways 316 and 318) can be about 0.15 inches (measured from the shorting ring to the last via). The radial distance to the L2 radiator feed conductor (e.g., feed conductor 312) can be about 1.82 inches.

According to some embodiments, the L1 substrate (e.g., substrate 322) and L2 substrate (e.g., substrate 302) are about 0.125 inches thick and have dielectric constants of about 2.33 and loss tangents of about 0.009. According to some embodiments, a based-plate (e.g., base-plate 301) is formed of a substrate about 0.031 inches thick with the same dielectric constant and loss tangents. According to some embodiments, the base-plate is about 6.75 inches on a side or 6.75 inches in diameter. According to some embodiments, the base-plate is formed of a metal plate, such as copper, copper alloys, aluminum, aluminum alloys, steel, and so on. In some embodiments, the base-plate can be formed of plastics, such as engineering plastics.

Radiating layers and ground planes can be formed as conducting films, such as metal films (e.g., aluminum, copper, gold, silver, etc.), deposited on the underlying substrate. In some embodiments, one or more radiating layers and/or ground planes are formed of sheet metal or machined metal.

According to some embodiments, one or more substrates can be composed of Taconic TLP-3. Examples of other commercially available substrate material that may be used are FR4, RO3002, RO6002, RO5880, and/or RO5880LZ from Rogers Corporation.

According to some embodiments, dual and multi-band antennas can be configured to operate in other frequency bands. For example, antennas can be configured to operate in other GNSS communication bands such as the GLONASS and/or Galileo bands. Some embodiments can be configured to operate in other satellite communication bands, such as in the S-band (2 to 4 GHz), C-band (4 to 8 GHz), X-band (8 to 12 GHz), and so on. Some embodiments can be configured to operate at lower frequencies such as in the HF Band (3 to 30 MHz), VHF Band (30 to 300 MHz), and/or UHF Band (300 to 1000 MHz). Some embodiments can operate over a Wireless Local Area Network (WLAN) in the 2.4 GHz and/or 5 GHz wireless bands in accordance with the IEEE 802.11 protocols.

In some embodiments, single-frequency antennas can be configured to operate in any GNSS band, such as but not limited to the GPS L1, L2, and L5, Gallileo G1, G2 and G6, Beidou L1 and L2, and GLONASS L1 and L2. Multi-band antennas, according to some embodiments, can be configured to operate in any combination of these, or other, GNSS bands. In some embodiments, a tri-band antenna is configured to operate in the GPS L1 and L2 and GALILEO E6 frequency bands. In some embodiments, a quad band antenna is configured to operate in GPS L1, L2, and L5 and GALILEO E6 frequency bands.

Coplanar Waveguide Transition

Dual-band stacked microstrip antennas such as antenna 300 of FIGS. 3A-3D can include two radiating layers, each with its own resonant frequency defined by its geometry and material properties. Because the two radiators have different geometry and different operating frequencies (resonant frequencies), the radiating layer impedance at a given radial location may not be the same for each radiator. For example, the location of 50 ohm impedance of the first layer may be at a first radial distance whereas the location of 50 ohm impedance of the second layer may be at a second radial distance. Thus, a feed conductor that extends straight through both radiators, according to conventional design, cannot be placed for optimal impedance matching for both radiators simultaneously. In contrast, in some embodiments described further below, feed structures are included with independent placements of feed conductors at each layer, such that the feed conductor for a given layer can be placed (independently of other layers) at an optimum location. This structure enables the feed conductor for a second radiator to be offset from the feed conductor for a first radiator, for example, as discussed above with respect to feed conductors 312 and 332 of dual-band antenna 300 of FIGS. 3A-3D.

This offsetting ability can enable optimal placement of feed conductors for each radiator for tailored impedance matching at each radiator. The feed conductor of the first radiator (the bottom-most radiator) extends down through the first substrate and ground plane to join with a connector for connecting a feed line to the antenna. The feed conductor of the upper radiator, however, only extends through the upper substrate from the lower radiating layer to the upper radiating layer. Joining the two feed conductors is a coplanar waveguide transition disposed in the radiating layer of the first (lower) radiator. This coplanar waveguide transition can comprise a conductive strip that extends within the radiating layer of the first radiator from the top of one feed conductor to the bottom of the other. This conductive strip is electrically insulated from the rest of the lower radiating layer. Since the first radiator is not resonant at the resonant frequency of the second radiator, an electrical signal at the second radiator's resonant frequency does not excite the first radiator, and thus, does not lose significant power as it travels up the first feed conductor and across the coplanar waveguide transition. Similarly, when exciting the first radiator, no power is lost to the second radiator because the second radiator does not resonate at the resonance frequency of the first radiator.

Figure 4A:
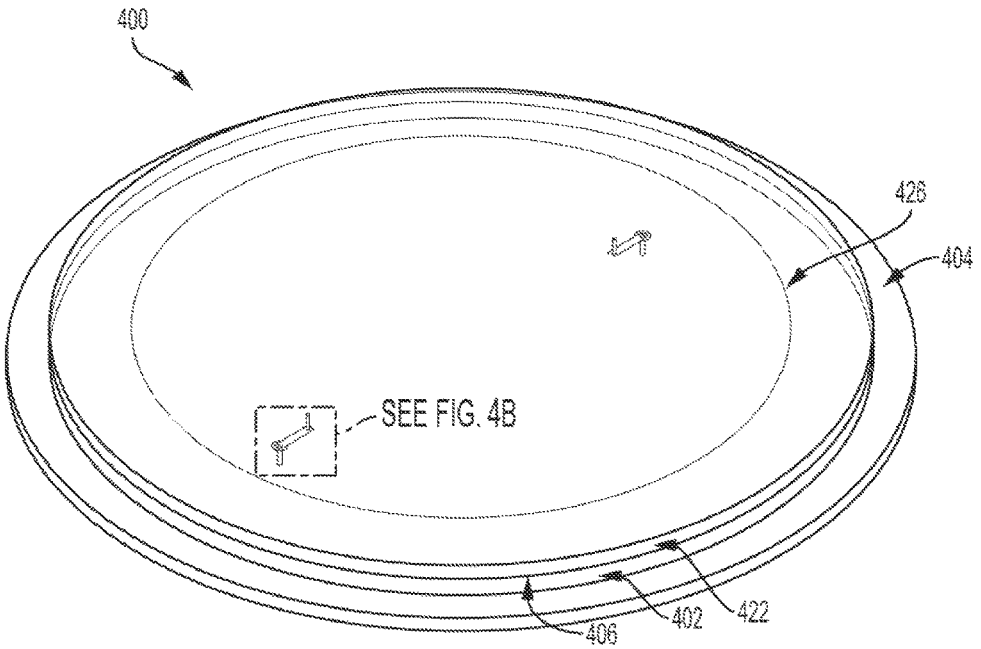
FIG. 4A is an isometric view of a microstrip patch antenna with a coplanar waveguide transition, according to some embodiments.
Figure 4B:
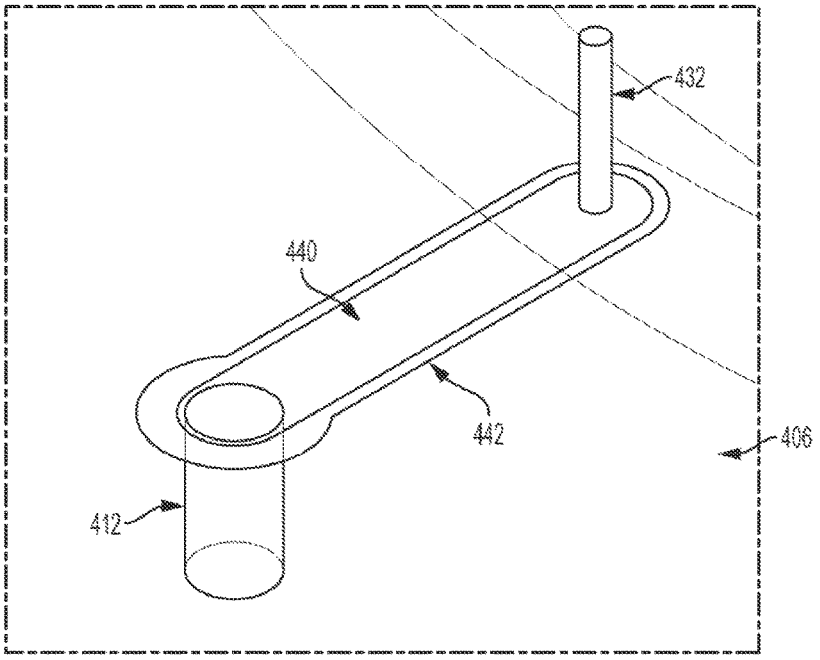
FIG. 4B is a close-up isometric view of the coplanar waveguide transition in FIG. 4A, according to some embodiments.

Antenna 400, shown in FIGS. 4A and 4B, illustrates the features of a coplanar waveguide transition according to some embodiments. Dual-band antenna 400 can be any stacked microstrip antenna including a shorted annular ring antenna or shorted annular ring antenna with shunted stubs, such as antenna 300 of FIG. 3. Antenna 400 can be any other shaped microstrip antenna, such as a square or rectangular antenna. Although antenna 400 is shown with two layers, any number of layers can be stacked and include a coplanar waveguide transition at each layer according to some embodiments.

Antenna 400 includes two radiators. The first radiator (lower radiator) is formed of ground plane 404, first substrate 402, and first radiating layer 406. The second radiator (upper radiator) is formed of first radiating layer 406 (which can function as a ground plane for the second radiator at the resonant frequency of the second radiator), second substrate 422, and second radiating layer 426.

Feed conductor 412 extends through ground plane 404 and substrate 402 to first radiating layer 406. Feed conductor 412 is electrically insulated from other portions of first radiating layer 406 (i.e., feed conductor 412 is separated from the rest of the conductive layer by an insulating ring). Feed conductor 412 may be connected to a signal conductor of feed connector 450, as discussed above with respect to feed connector 350 of antenna 300. According to some embodiments, feed conductor 412 can be positioned to provide impedance matching between an input and radiating layer 306, for example, in the manner discussed above with respect to feed conductor 212 of FIG. 2.

Feed conductor 432 extends from first radiating layer 406 through second substrate 422 to second radiating layer 426. Feed conductor 432 is electrically insulated from first radiating layer 406. According to some embodiments, feed conductor 432 is positioned to provide impedance matching between a first radiator impedance at the location of feed conductor 412 and second radiating layer 426.

Feed conductor 432 is electrically connected to feed conductor 412, and thus to a feed source, by coplanar waveguide (CPW) transition 440. An expanded view of CPW transition 440 is provided in FIG. 4B. In some embodiments, CPW transition 440 is a conductive strip disposed in first radiating layer 406 that electrically connects the top of feed conductor 412 to the bottom of feed conductor 432. Gap 442 is provided between CPW transition 440 and the surrounding portion of first radiating layer 406 to electrically insulate CPW transition 440 from the surrounding conductive material. In some embodiments, gap 442 maintains a continuous width throughout. In other embodiments, portions of gap 442 may vary in width (such as in FIG. 4B where the portion of the gap around first feed conductor 412 is wider than elsewhere in the gap). In some embodiments, the width of CPW transition 440 is constant. In other embodiments, the width varies from one end to the other. In some embodiments, the geometries of CPW transition 440 and gap 442 are selected to optimize impedance matching by providing some impedance transformation from the top of feed conductor 412 to the bottom of feed conductor 432.

As stated above, when a feed line feeds antenna 400 with an electrical signal having a frequency corresponding to the resonant frequency of the second (upper) radiator, the electrical signal travels from the feed line, up through feed conductor 412, across CPW transition 440 to the bottom of feed conductor 432, and up feed conductor 432 to second radiating layer 426. Because of the electrical isolation created by gap 442 and because first radiating layer 406 does not resonate at the frequency corresponding to the resonant frequency of the second radiator, no (or minimal) power is lost through CPW transition 440. When the feed line feeds antenna 400 with an electrical signal having a frequency corresponding to the resonant frequency of the first (lower) radiator, the electrical signal travels from the feed line, up through feed conductor 412, where it excites the corresponding resonant frequency in first radiating layer 406. Although feed conductor 412 is not electrically connected to first radiating layer 406, capacitive coupling across gap 442 communicates radiative power to first radiating layer 406.

In some embodiments, the feed pins of the two radiators are aligned along a single radial line, such as in antenna 400. However, the feed pins may be unaligned and generally located anywhere relative to one another without departing from the principles of operation of CPWs as described herein. Further, although shown as a straight strip, in some embodiments, a CPW transition can follow any path from one feed conductor to the other. For example, a CPW transition may be curved to provide a desired impedance transformation.

According to some embodiments, a dual-band SAR patch antenna for L1 and L2 GPS operation includes radiating layers with impedance ranges from 0 ohm at the shorted inner radius to 200-300 ohm at the outer radius. The position of the feed to optimally match a 50 ohm source is different for the L1 and L2 layers. The SAR patch antenna feed configuration includes a CPW transition between the L1 and L2 feeds. A PCB via extends from the beneath the ground plane to the top of the L2 layer, which acts as the source for the L2 antenna. The top of the L2 excitation via is connected to the center conductor of a CPW transition section, which extends to a via going up through the L1 antenna layer. In this way, the L1 and L2 vias can be placed independently to optimize impedance matching for both frequency bands.

By using CPWs in stacked multi-band microstrip antennas, feed conductors can be independently placed (relative to one another) to enable impedance matching for each radiating layer at its operating frequency. This can reduce impedance mismatch, maximizing the antenna's gain at each operating frequency.

Simulated Performance

Figure 5A:
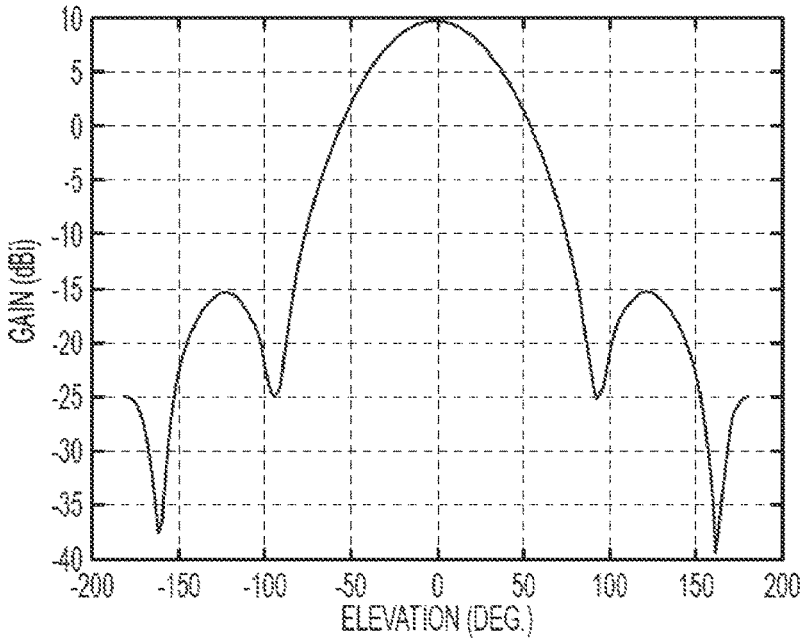
FIG. 5A is an illustration of the gain pattern simulation results at azimuth=0 degrees for a first frequency band of a dual-band SAR antenna with shunted stubs, according to some embodiments.

FIGS. 5A-7B provide radiating field simulation results for a dual-band antenna configured to operate in the L1 and L2 GPS bands (e.g., antenna 300) according to some embodiments. FIGS. 5A and 5B illustrate the gain characteristics of the radiating field of the L1 radiator. For example, in some embodiments of antenna 300, the upper radiator is configured to resonate at the L1 center frequency of 1575.42 MHz. FIG. 5A illustrates the gain versus elevation at the center L1 frequency, with zero elevation being orthogonal to the radiating layer plane. As illustrated, the peak gain, which is at zero degrees elevation, is about 10 dBi (decibels relative to an isotropic antenna). The first null (local gain minima) is located at +/−90 degrees, which, as discussed above, can be achieved by adjusting the outer diameter of the radiating layer (second radiating layer 326). This illustrates the anti-jamming capability of some embodiments, wherein a gain null at the horizon can ensure that signals received from terrestrial sources (e.g., jamming signals) have minimal effect on the response of the antenna. According to some embodiments, the HPBW can be increased by moving the null away from the horizon. However, as illustrated in FIG. 5A, the HPBW can cover at least +/−30 degrees from zenith, which is generally sufficient for GPS reception, while maintaining a null at the horizon.

Figure 5B:
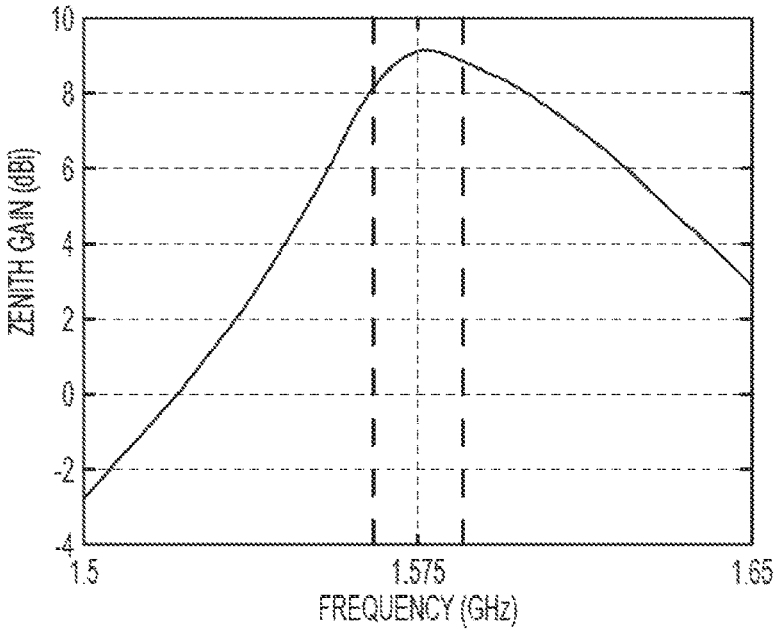
FIG. 5B is an illustration of gain versus frequency simulation results for a first frequency band of a dual-band SAR antenna with shunted stubs, according to some embodiments.

FIG. 5B illustrates the gain of the radiation field of the antenna with respect to frequency about the L1 center frequency. The dashed vertical lines delineate the 20 MHz frequency band for L1 communication (centered about the 1575.42 MHz center frequency). This chart shows that the antenna can have good gain across the 20 MHz band.

Figure 5C:
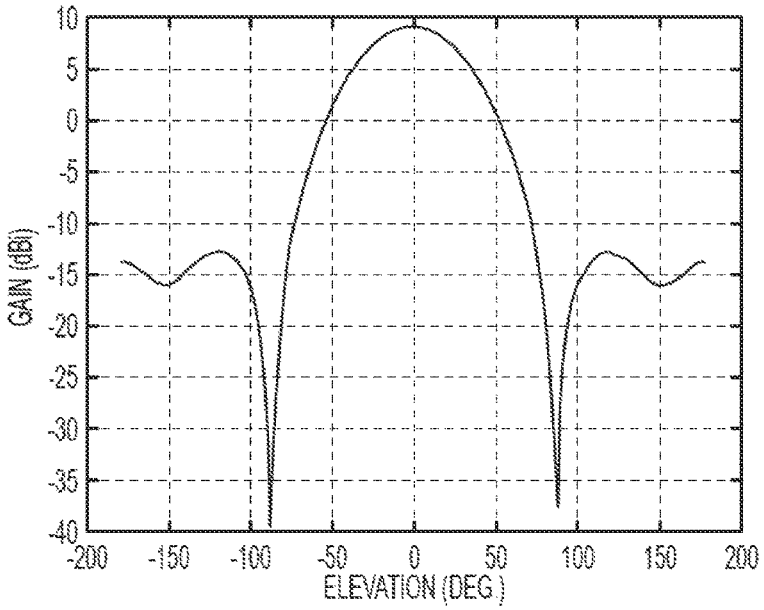
FIG. 5C is an illustration of the gain pattern simulation results at azimuth=0 degrees for a second frequency band of a dual-band SAR antenna with shunted stubs, according to some embodiments.
Figure 5D:
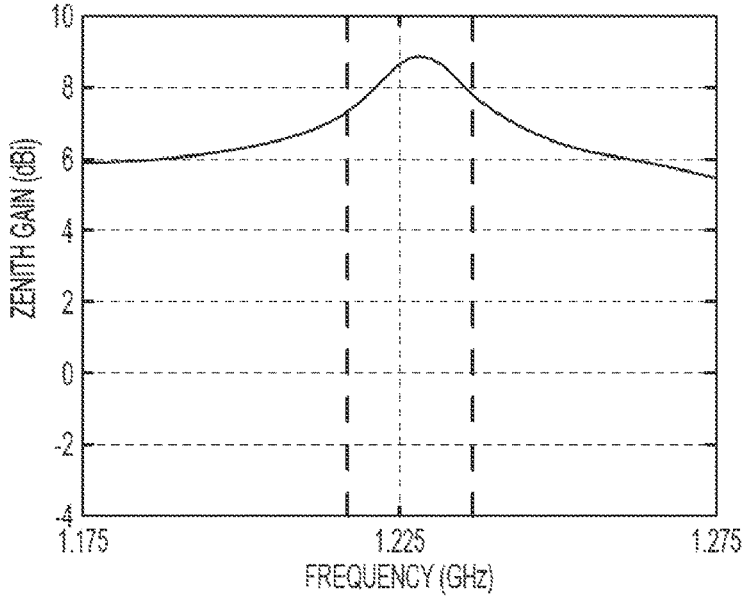
FIG. 5D is an illustration of gain versus frequency simulation results for a second frequency band of a dual-band SAR antenna with shunted stubs, according to some embodiments.

FIGS. 5C and 5D illustrate the gain characteristics of the radiating field of the L2 radiator. For example, in some embodiments of antenna 300, the lower radiator is configured to resonate at the L2 center frequency of 1227.60 MHz. FIG. 5C illustrates the gain versus elevation at the center L2 frequency, with zero elevation being orthogonal to the radiating layer plane. As illustrated, the peak gain, which is at zero degrees elevation, is a little less than 10 dBi. The first null (local gain minima) is located at +/−90 degrees, which, as discussed above, can be achieved by adjusting the outer diameter of the radiating layer (first radiating layer 306). This illustrates the anti-jamming capability of some embodiments, wherein a gain null at the horizon can ensure that signals received from terrestrial sources (e g, jamming signals) have minimal effect on the response of the antenna. According to some embodiments, the HPBW can be increased by moving the null away from the horizon. However, as illustrated in FIG. 5A, the HPBW can cover at least +/−30 degrees from zenith, which is generally sufficient for GPS reception, while maintaining a null at the horizon.

FIG. 5D illustrates the gain of the radiation field of the antenna with respect to frequency about the L2 center frequency. The dashed vertical lines delineate the 20 MHz frequency band for L2 communication (centered about the 1227.60 MHz center frequency). This chart shows that the antenna can have good gain across the 20 MHz band.

Figure 6A:
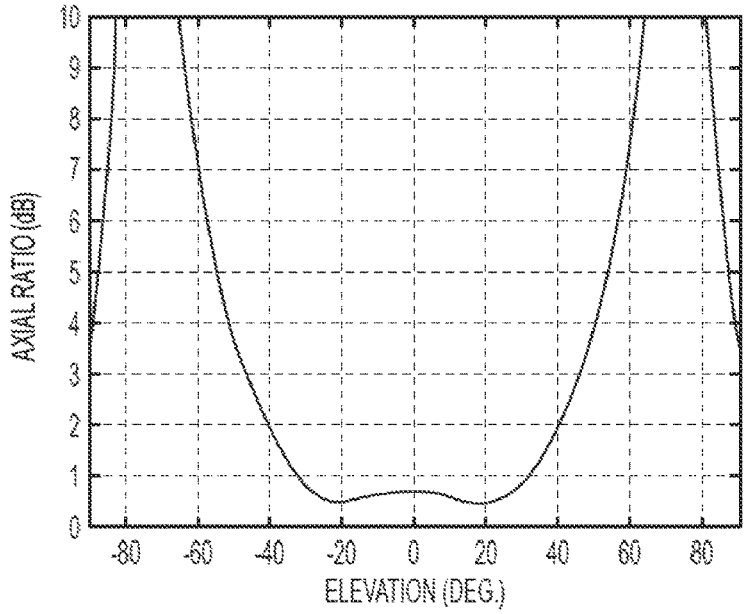
FIG. 6A is an illustration of axial ratio versus elevation simulation results for a first frequency band of a dual-band SAR antenna with shunted stubs, according to some embodiments.
Figure 6B:
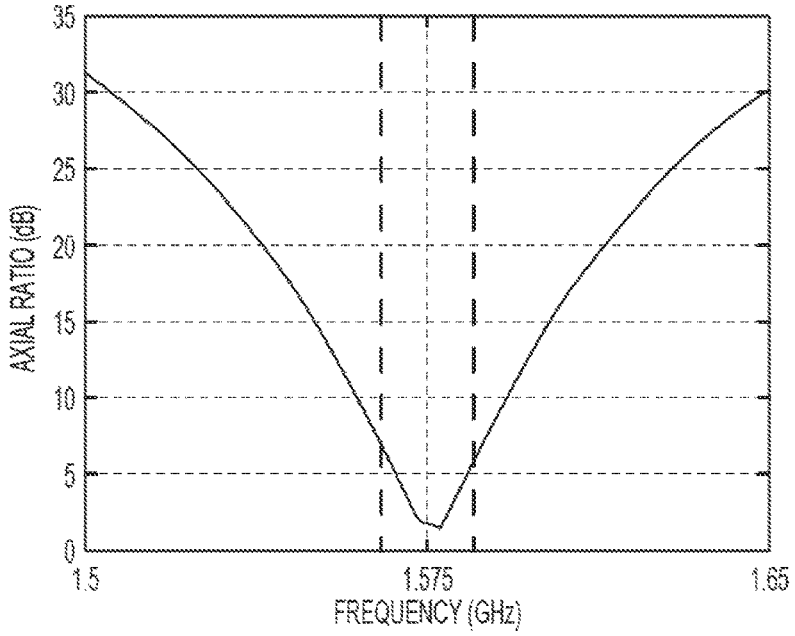
FIG. 6B is an illustration of axial ratio versus frequency simulation results for a first frequency band of a dual-band SAR antenna with shunted stubs, according to some embodiments.
Figure 6C:
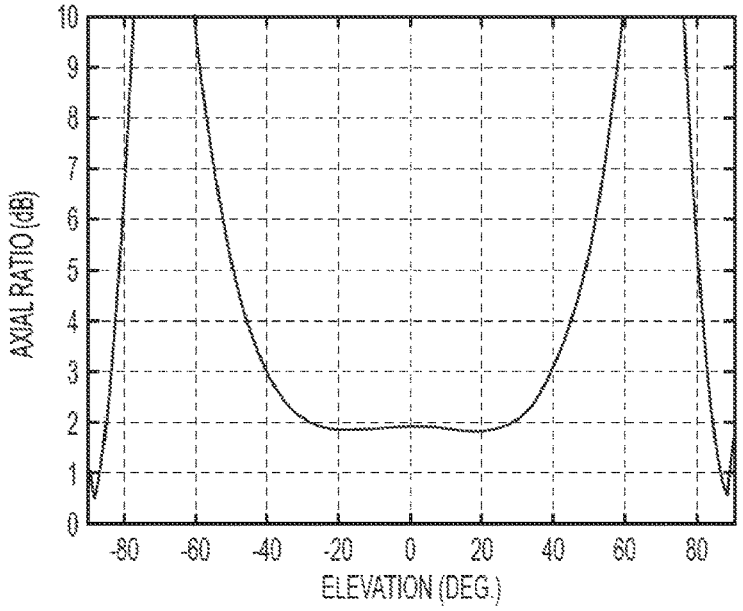
FIG. 6C is an illustration of axial ratio versus elevation results for a second frequency band of a dual-band SAR antenna with shunted stubs, according to some embodiments.
Figure 6D:
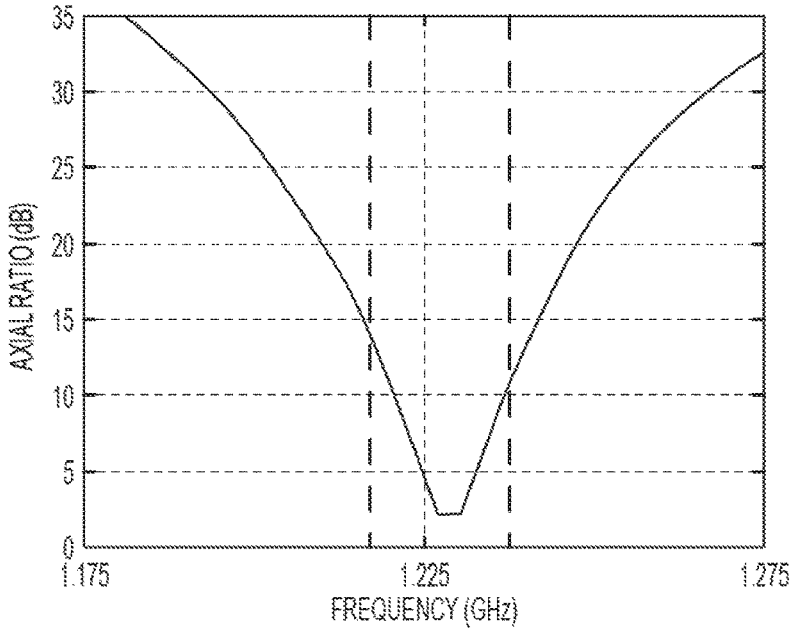
FIG. 6D is an illustration of axial ratio versus frequency simulation results for a second frequency band of a dual-band SAR antenna with shunted stubs, according to some embodiments.

FIGS. 6A and 6B illustrate the axial ratio characteristics of the radiating field of the L1 radiator, according to some embodiments. As is known in the art, axial ratio is the ratio of orthogonal components of a radiating field. A circularly polarized field is made up of two orthogonal components of equal amplitude (and 90 degrees out of phase), as discussed above. Because the components are equal magnitude, the axial ratio of a perfectly circular radiation field is 1 (or 0 dB). In contrast, the axial ratio for pure linear polarization is infinite, because the orthogonal component of the field is zero. FIG. 6A shows the axial ratio versus elevation and FIG. 6B shows the axial ratio versus frequency (with the 20 MHz frequency band indicated by the vertical lines). FIGS. 6C and 6D illustrate the axial ratio characteristics of the radiating field of the L2 radiator, according to some embodiments. FIG. 6C shows the axial ratio versus elevation and FIG. 6D shows the axial ratio versus frequency (with the 20 MHz frequency band indicated by the vertical lines).

Figure 7A:
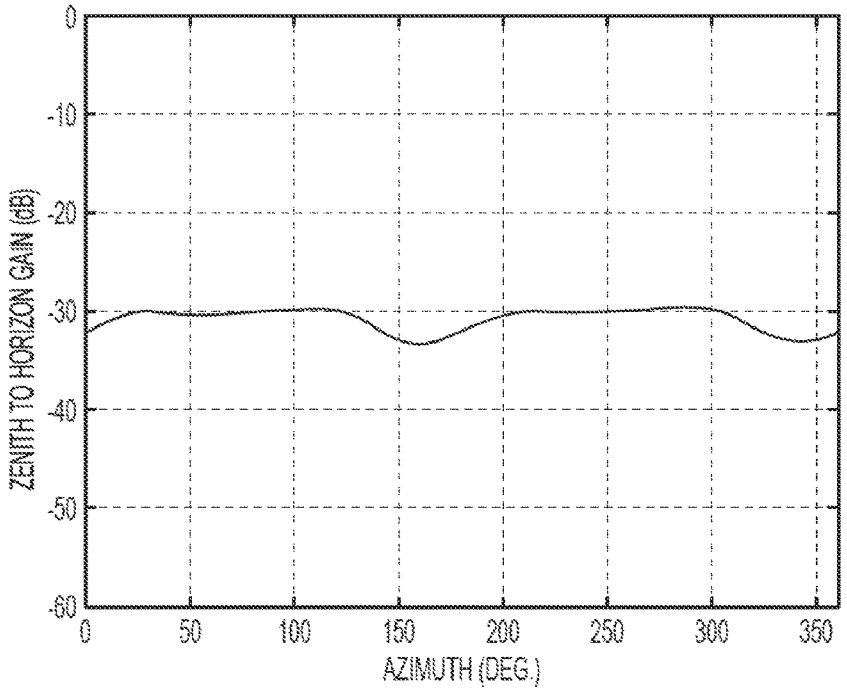
FIG. 7A is an illustration of zenith-to-horizon gain versus azimuth simulation results for a first frequency band of a dual-band SAR antenna with shunted stubs, according to some embodiments.
Figure 7B:
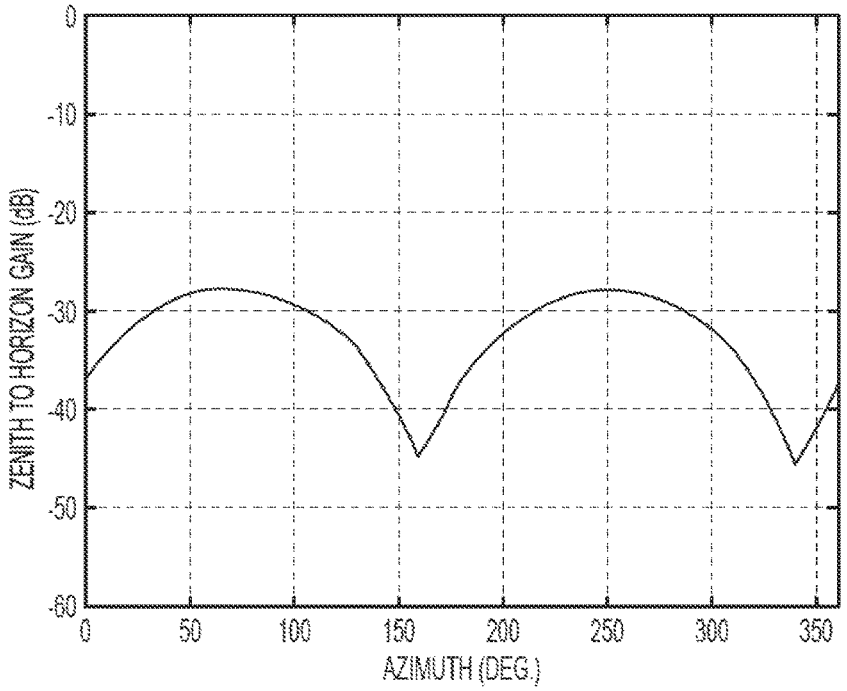
FIG. 7B is an illustration of zenith-to-horizon gain versus azimuth simulation results for a second frequency band of a dual-band SAR antenna with shunted stubs, according to some embodiments.

FIGS. 7A and 7B illustrate the zenith-to-horizon gain difference (null depth) over azimuth of dual-band antennas according to some embodiments. FIG. 7A illustrates the characteristics of the L1 radiating field and FIG. 7B illustrates the characteristics of the L2 radiating field. These charts illustrate the anti-jamming capability of the antenna, where the gain difference between the gain at zenith (orthogonal to the radiating planes) and the gain at the horizon (+/−90 degrees in elevation) is around −30 dBi. Thus, signals received by the antenna from its horizon are much weaker (if detected at all) relative to signals of the same power received by the antenna from its zenith. These charts indicate that a good null is achieved around the full azimuth of the antenna.

Antennas can be configured with many different performance characteristics in accordance with the designs and principals described herein. In some embodiments, the HPBW can cover at least +/−90 degrees from zenith (no horizon nulling), at least +/−80 degrees from zenith, at least +/−70 degrees from zenith, at least +/−60 degrees from zenith, at least +/−50 degrees from zenith, at least +/−40 degrees from zenith, at least +/−20 degrees from zenith, or at least +/−10 degrees from zenith.

According to some embodiments, a null can be placed at a different location than the horizon, if desired, by adjusting the outer diameter of the radiating layer. For example, the null can be placed at +/−60 degrees from zenith, +/−45 degrees from zenith, and so on.

Some embodiments may be configured with a peak gain greater than 2 dBi, greater than 5 dBi, greater than 7 dBi, greater than 9 dBi, or greater than 10 dBi. Some embodiments may be configured with peak gain less than 20 dBi, less than 15 dBi, less than 10 dBi, less than 5 dBi, or less than 2 dBi.

In some embodiments, the RHCP axial ratio at the center frequency can be less than 1 within +/−60 degrees elevation. In some embodiments, the axial ratio can be less than 1 dB within +/−60 degrees elevation, less than 1 dB within +/−45 degrees elevation, less than 1 dB within +/−30 degrees elevation, less than 1 dB within +/−20 degrees elevation, or less than 1 dB within +/−10 degrees elevation. In some embodiments, the RHCP axial ratio is less than 2 dB, less than 1.5 dB, less than 0.9 dB, less than 0.7 dB, less than 0.5 dB, less than 0.3 dB, or less than 0.1 dB within less than +/−60 degrees elevation, within +/−45 degrees elevation, or within +/−30 degrees elevation.

Some embodiments can be configured with a minimum null depth around azimuth at center frequency that is at least −10 dBi, at least −15 dBi, at least −20 dBi, at least −25 dBi, at least −30 dBi, or at least −40 dBi. Some embodiments can be configured with a maximum null depth delta (difference between minimum null depth and maximum null depth around azimuth) at center frequency that is less than 1 dBi, less than 2 dBi, less than 3 dBi, less than 5 dBi, less than 10 dBi, or less than 20 dBi.

Shorted annular ring patch antennas with shunted stubs, according to the above description, can provide circular polarization with as little as one feed port. Multiple shorted annular ring patch antennas can be stacked to create multiple resonances for multi-band operation. Antennas can be configured with a null in the gain pattern at the horizon to attenuate interfering signals coming from the horizon. According to some embodiments, resonances created by the shunt stubs are wide enough in frequency to operate efficiently over a desired bandwidth (e.g., L1 and L2)), but narrow enough to enhance out-of-band rejection. Antennas described herein can be manufactured using standard PCB methods enabling low-cost and low-weight antennas. Embodiments of the described antennas can be used in base stations, vehicles, airplanes, and the like.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated herein by reference.

What is claimed as new and desired to be protected by Letters Patent of the United States is:

1. A microstrip antenna comprising:

a substrate;

a ground layer disposed on a first side of the substrate;

a first radiating layer disposed on a second side of the substrate opposite the first side;

one or more first electrically conductive pathways extending from the ground layer to the first radiating layer, wherein the one or more first electrically conductive pathways form a ring about an axis;

a feed conductor for connecting the antenna to a feed line; and one or more second electrically conductive pathways extending from the ground layer to the first radiating layer, wherein the one or more second electrically conductive pathways are oriented with respect to the feed conductor so as to generate a circularly polarized radiation field in response to receiving an electrical signal through the feed conductor and wherein the one or more second electrically conductive pathways form a first line that extends radially from the ring and stops short of an outer perimeter of the first of the first radiating layer.

2. The microstrip antenna of claim 1, wherein the first line intersects the axis of the ring.

3. The microstrip antenna of claim 1, wherein a second line intersecting the feed pin and the axis forms an acute angle with the first line.

4. The microstrip antenna of claim 3, wherein the acute angle is in a range from 30 to 60 degrees.

5. The microstrip antenna of claim 3, wherein the acute angle is in a range from 40 to 50 degrees.

6. The microstrip antenna of claim 3, wherein the acute angle is about 45 degrees.

7. The microstrip antenna of claim 1, wherein first radiating layer is circular.

8. The microstrip antenna of claim 1, wherein the one or more first electrically conductive pathways comprise a plurality of conductive vias extending through the thickness of the substrate.

9. The microstrip antenna of claim 8, wherein the plurality of conductive vias comprises circumferential spacing of less than one-twentieth of a resonant frequency wavelength of the radiating layer.

10. The microstrip antenna of claim 1, wherein the one or more second electrically conductive pathways comprise a plurality of conductive vias extending through the thickness of the substrate.

11. The microstrip antenna of claim 1, wherein the axis extends perpendicularly to the substrate.

12. The microstrip antenna of claim 1, wherein the microstrip antenna is configured with an operating frequency gain null extending circumferentially about the axis.

13. The microstrip antenna of claim 12, wherein the gain null is at least 45 degrees from the axis.

14. The microstrip antenna of claim 12, wherein the gain null is at least 80 degrees from the axis.

15. The microstrip antenna of claim 12, wherein the gain null comprises a gain that is at least 10 decibels relative to an isotropic antenna (dBi) less than a gain at a zenith of the antenna.

16. The microstrip antenna of claim 15, wherein the gain is at least 20 dBi less than the gain at the zenith of the antenna.

17. The microstrip antenna of claim 1, comprising:

a second substrate disposed on the first radiating layer;

a second radiating layer disposed on a side of the second substrate opposite the first radiating layer;

one or more third electrically conductive pathways extending from the first radiating layer to the second radiating layer, wherein the one or more third electrically conductive pathways form a second ring about a second axis;

one or more fourth electrically conductive pathways extending from the first radiating layer to the second radiating layer, wherein the one or more fourth electrically conductive pathways are disposed along a portion of a second line extending outwardly from the second ring; and a second feed conductor electrically connected to the feed conductor, the second feed conductor configured to provide radiative energy to the second radiating layer.

* * * * *